United States Patent [19]

Nation

[11] Patent Number: 4,565,905

[45] Date of Patent: Jan. 21, 1986

[54] LOUDSPEAKER CONSTRUCTION

[75] Inventor: Melvin S. Nation, Elmhurst, Ill.

[73] Assignee: International Jensen Incorporated, Schiller Park, Ill.

[21] Appl. No.: 608,385

[22] Filed: May 9, 1984

Related U.S. Application Data

[63] Continuation-in-part of Ser. No. 372,744, Apr. 28, 1982, Pat. No. 4,465,905.

[51] Int. Cl.[4] ..... H04R 9/00; H04R 9/04; H04R 9/06

[52] U.S. Cl. ..... 179/115.5 PC; 179/115.5 R; 179/115.5 VC; 179/115.5 PS; 179/116

[58] Field of Search ..... 179/115.5 PC, 115.5 R, 179/115.5 VC, 115.5 PS, 116, 117, 119 R, 120

[56] References Cited

U.S. PATENT DOCUMENTS

| | | | |
|---|---|---|---|
| D. 253,108 | 10/1979 | Schroeder | 179/115.5 PS |
| 2,566,604 | 9/1951 | Eaves | 179/115.5 R |
| 2,568,621 | 1/1951 | Hopkins et al. | 179/115.5 R |
| 2,755,343 | 7/1956 | Levy | 179/115.5 R |
| 3,014,996 | 12/1961 | Swanson | 179/115.5 VC |
| 3,032,615 | 5/1962 | Hanson | 179/115.5 VC |
| 3,118,972 | 1/1964 | Walczak | 381/96 |
| 3,176,086 | 3/1965 | Coen | 179/119 |
| 3,340,604 | 9/1967 | Parain | 29/594 |
| 3,498,329 | 3/1970 | McCormick | 179/115.5 R |
| 3,779,337 | 12/1973 | Gregory | 181/ |
| 3,983,337 | 9/1976 | Babb | 179/115.5 R |
| 4,068,103 | 1/1978 | King et al. | 179/115.5 R |
| 4,122,315 | 10/1978 | Schroeder et al. | 179/115.5 PS |
| 4,144,416 | 3/1979 | Babb | 179/115.5 R |
| 4,158,756 | 6/1979 | Keezer | 179/115.5 R |
| 4,246,450 | 1/1981 | Barber | 179/115.5 R |
| 4,443,667 | 4/1984 | Hunt | 179/117 |

FOREIGN PATENT DOCUMENTS

| | | | |
|---|---|---|---|
| 1901976 | 1/1970 | Fed. Rep. of Germany . | |
| 2133498 | 12/1972 | France . | |
| 55-46674 | 4/1980 | Japan | 179/115.5 PS |
| 55-127797 | 10/1980 | Japan . | |
| 638080 | 7/1947 | United Kingdom | 179/115.5 PC |
| 1099425 | 1/1968 | United Kingdom . | |
| 1123082 | 8/1968 | United Kingdom | 179/115.5 PC |
| 1530286 | 10/1978 | United Kingdom . | |
| 310421 | 8/1973 | U.S.S.R. | 179/115.5 R |

*Primary Examiner*—Thomas W. Brown
*Assistant Examiner*—Danita R. Byrd
*Attorney, Agent, or Firm*—Willian, Brinks, Olds, Hofer, Gilson & Lione

[57] ABSTRACT

A loudspeaker allowing snap-together assembly and extensive use of plastic is provided. The magnet is substantially enclosed between a molded plastic basket and a threaded cap, and the magnet clamps the spider which centers the voice coil in place. The base of the cone of the loudspeaker is frictionally held between the basket and a clamping ring. The electrical connection between the voice coil and the input terminals includes conductive strips formed of conductive ink upon the spider. The conductive strips are soldered to the leads of the voice coil and are joined to the input terminals by pressure contacts of a terminal strap which is snapped in place in the plastic basket. A grille subassembly for mounting within the basket of the loudspeaker is provided to permit snap-together assembly of multiple loudspeaker systems. The electrical connections between the loudspeakers of the multiple loudspeaker system are made at final assembly by the terminal strap. A novel grille and support arrangement for the smaller speakers, as well as a novel positioning ring for the magnet assembly, are also disclosed.

36 Claims, 36 Drawing Figures

FIG. 4
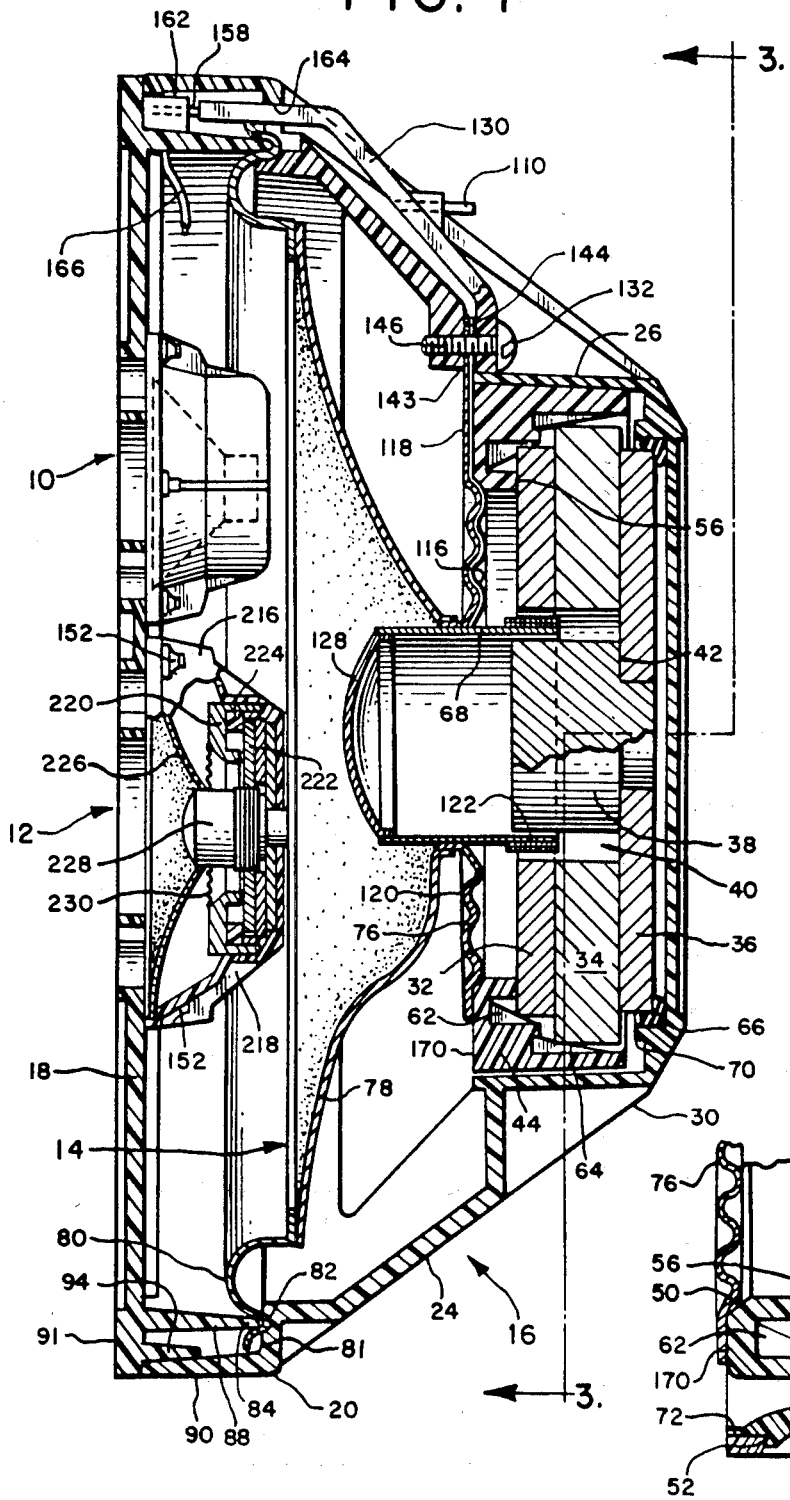
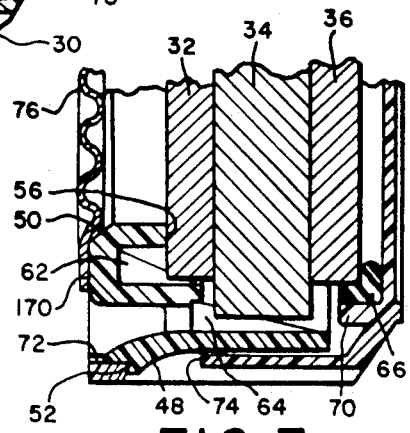
FIG. 7

FIG. 18
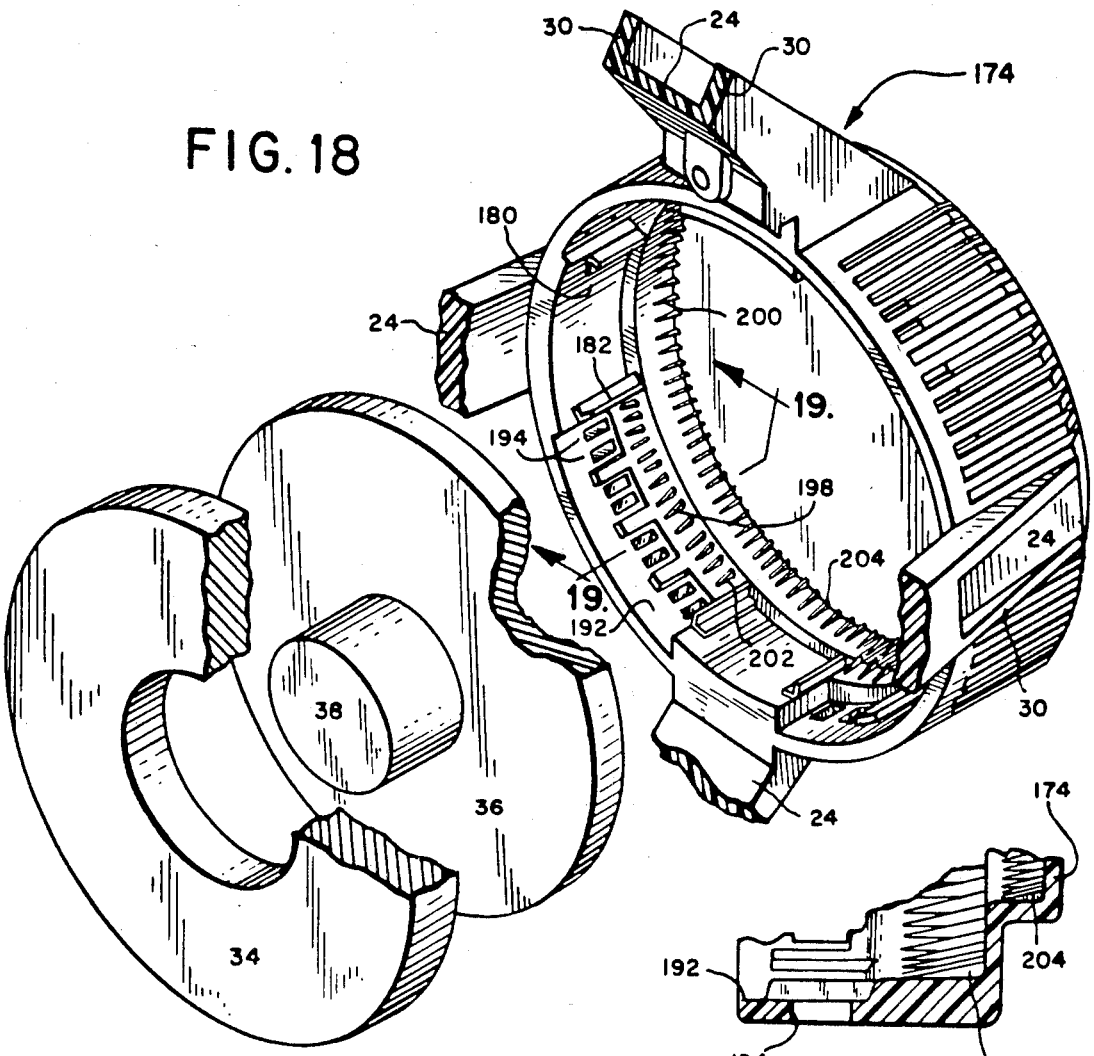
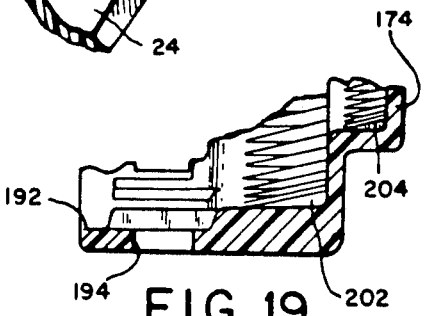
FIG. 19
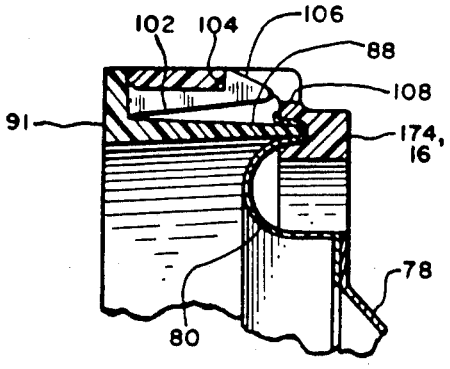
FIG. 20
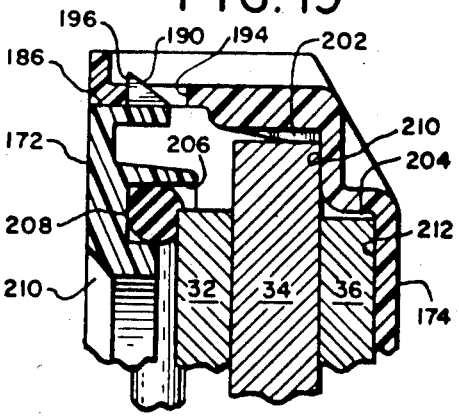
FIG. 21

FIG. 28
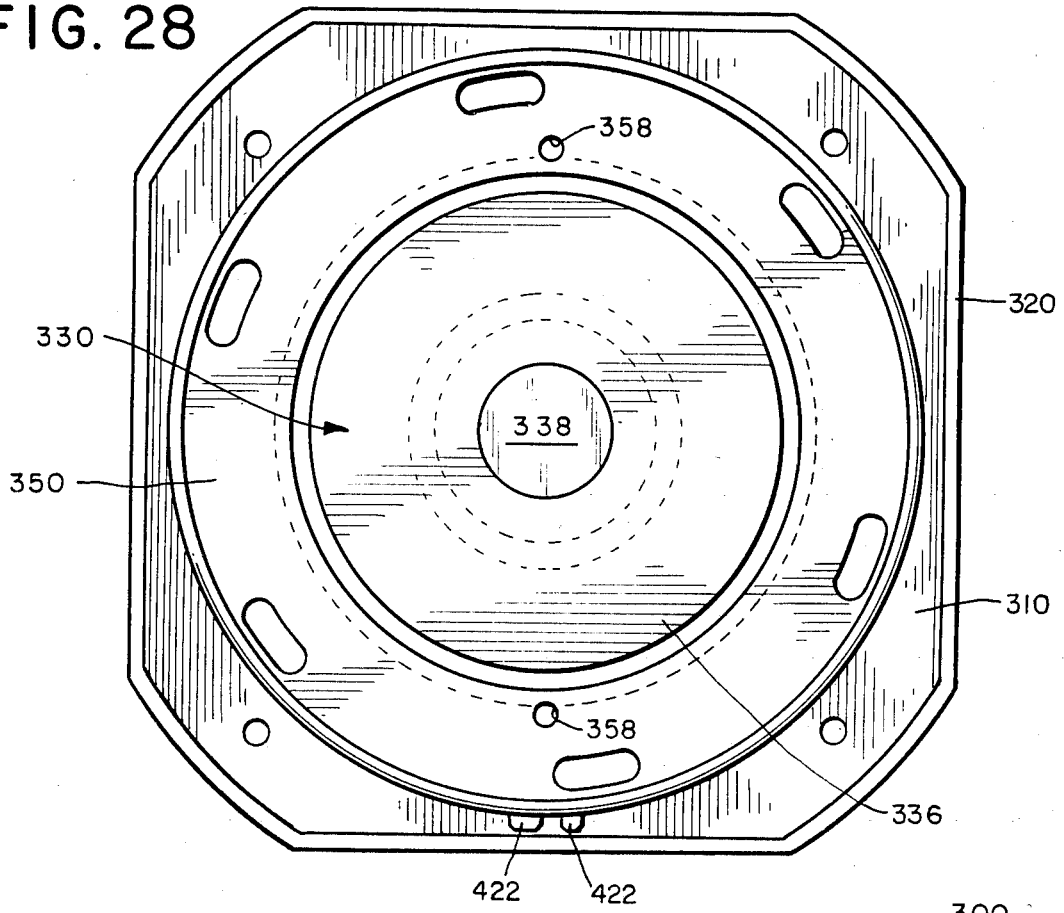
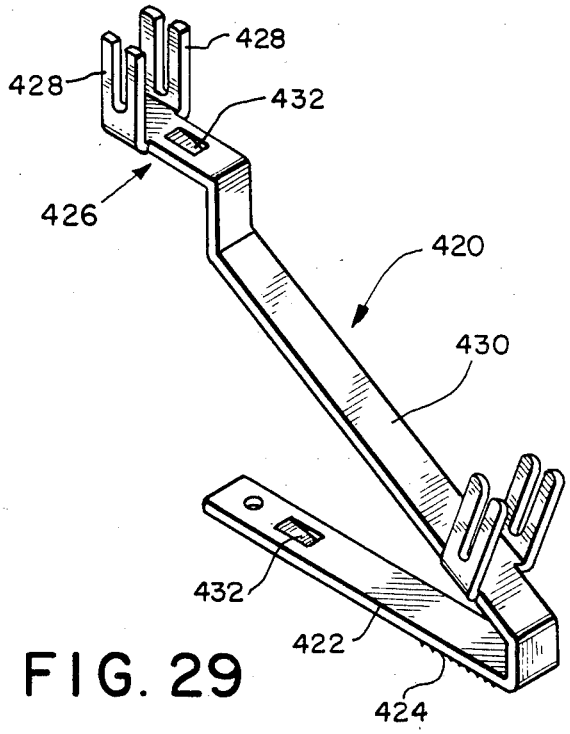
FIG. 29
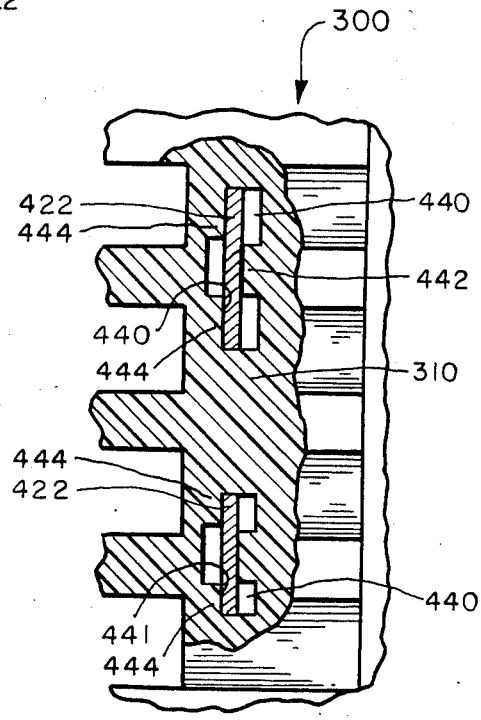
FIG. 30

LOUDSPEAKER CONSTRUCTION

CROSS REFERENCE TO RELATED APPLICATION

This application is a continuation in part of copending application Ser. No. 06/372,744, filed Apr. 28, 1982 now U.S. Pat. No. 4,465,905.

BACKGROUND OF THE INVENTION

The present invention relates to a novel loudspeaker construction.

Typically, loudspeakers include a conical diaphragm or cone, formed of paper or other material, which is caused to vibrate by movement of a voice coil located near the apex of the cone. The cone may taper inward from a circular, elliptical, or polygonal base in a variety of configurations. Generally, the voice coil is wound on a thin cylindrical tube which moves within an annular gap of a magnet and is rigidly fixed to the cone. Such conventional loudspeakers may utilize a magnet assembly comprising several elements which are precisely aligned to provide an annular gap having a high gap flux. For example, the magnet assembly may include a ceramic magnetizable field member in the form of an annular ring, front and rear pole plates, and a cylindrical pole piece spaced within the front pole plate and field member so as to form the annular gap. For convenience, the term "magnet" will be used to refer to the entire magnet assembly in this specification.

Several constructions and methods have been devised for maintaining alignment of the elements of the magnet and for securing them to the loudspeaker chassis. The elements of the magnet may be mounted within a metal pot which is staked to a steel basket comprising the loudspeaker chassis during assembly. Although such construction provides some assurance that the annular gap is maintained, the elaborate configuration of the metal pot is expensive and illsuited to modern flat magnets. Another construction utilizes staking to secure a front pole plate to a steel loudspeaker basket while a rear pole plate and a field ring are cemented to the front pole plate by adhesive. Such construction facilitates fixing of the elements of the magnet to maintain the annular gap but, generally, results in distortion and weakening of the gap flux. Further, even with the use of modern adhesives, the elements of the magnet must be held in position for up to five hours while the adhesive cures, adding significantly to the manufacturing cost.

It has been suggested that a front pole plate may be secured to a molded plastic basket by encapsulating the edges of the front pole plate within a portion of the plastic basket. The remaining elements of the magnet may then be fixed to the front pole plate by adhesives in the manner previously described. This use of a molded plastic basket in place of a steel basket will reduce leakage of flux from the magnetic field within the annular gap and will result in a more uniform and higher level of gap flux. However, such suggested construction does not eliminate the manufacturing process in which the elements of the magnet are held in position while an adhesive cures. Further, such suggested construction leaves the field ring of the magnet visible and vulnerable to chipping and other damage, as only the front pole plate is encapsulated by the plastic basket.

It is therefore an object of the present invention to provide an improved loudspeaker assembly in which the basket of the loudspeaker does not reduce the magnetic flux within the annular gap and in which the elements of the magnet are not visible and are protected from chipping and other damage.

It is another object of the present invention to provide an improved method for securing the elements of a magnet of a loudspeaker to the basket of the loudspeaker such that material cost, manufacturing cost, and time of assembly are reduced while maintaining acoustical performance.

In conventional loudspeaker construction, the ends of the voice coil wire are electrically connected to flexible leads, generally formed of braided copper, which extend radially outward along the inside of the cone and are led through the cone to terminals supported from the loudspeaker basket to which the flexible leads are soldered. This manner of assembly is time consuming and requires considerable care and skill. Also, the flexible leads may interfere with the movement of the cone and may generate spurious sounds. Further, the flexible leads are subject to fatigue failure, particularly if solder penetrates the flexible leads and stiffens a portion of the flexible leads, a problem known as "wicking up" of the lead wires. Due to the frequency and amplitude of the vibration of the voice coil and cone relative to the basket of the loudspeaker to which the flexible leads are connected, breakage of the flexible leads is a major cause of loudspeaker failure.

It has been suggested that the flexible leads connected to the voice coil wires could be replaced by conductive strips painted upon or woven into a nonconductive centering disc or spider. However, the use of conductive strips upon a nonconductive centering disc or spider of a loudspeaker has been largely unsuccessful, in part because the known technology results in unacceptable resistance of the conductive strips and inability of the conductive strips to withstand repeated flexure or vibration. Other unsolved problems have been the high manufacturing cost of forming the conductive strips and difficulties related to establishing electrical connections between the conductive strips, the voice coil wires, and the terminals supported from the loudspeaker basket.

It is therefore a further object of the present invention to provide an improved electrical connection between the voice coil wires and the basket terminals of a loudspeaker by means of conductive strips having low resistance and the ability to withstand repeated flexure and vibration without impairment.

It is a further object of the present invention to provide an improved method of connecting the voice coil wires of a loudspeaker to a conductive strip formed upon a nonconductive centering disc or spider, resulting in ease of manufacture, reduced manufacturing cost, and positive electrical continuity.

It is a further object of the present invention to provide an improved method of connecting the terminals supported from the basket of a loudspeaker to a conductive strip formed upon a centering disc or spider of a loudspeaker resulting in ease of assembly, reduced manufacturing cost, and positive electrical continuity.

Particularly in loudspeakers designed for low frequency sound reproduction, conventional speakers may include a flexible member along the perimeter of the cone to facilitate axial displacement of the cone relative to the basket of the loudspeaker. Typically, this flexible member comprises a surround molded of a rubber or synthetic material which may be a thin layer of foam.

The surround is generally cemented along its internal perimeter to the cone and along its external perimeter to the basket of the loudspeaker. A pad ring is often cemented to the front of the basket of the loudspeaker to provide clearance for the surround and to facilitate mounting of supplementary loudspeakers. The cementing of the pad ring and the surround to the basket of the loudspeaker tends to avoid undesired resonances, but the operation is time consuming and expensive and requires considerable care and skill.

It is therefore a further object of the present invention to provide an improved method of mounting the surround and the pad ring of a loudspeaker upon the basket of a loudspeaker resulting in ease of assembly, reduced assembly time, and decreased manufacturing cost.

One or more smaller loudspeakers may be mounted within the cone of a larger loudspeaker. Typically, a bridge, formed as a metal stamping, is screwed to the front of the pad ring to provide a mounting for one or more smaller loudspeakers. In a three-way loudspeaker system, for example, a tweeter and midrange may be mounted upon a bridge which is mounted upon the woofer of a loudspeaker system. However, the assembly of such a loudspeaker system is generally difficult and tedious because of the large number of separate parts involved and the practice of threading the flexible electrical leads from the tweeter and midrange through the cone of the woofer to the terminals supported from the basket of the loudspeaker. Further, the interaction of the flexible leads with the cone of the woofer may generate spurious sounds, and the separate parts may produce undesired "ringing" and resonances.

It is therefore a further object of the present invention to provide an improved method of electrically connecting one or more loudspeakers mounted within the cone of a larger loudspeaker to the terminals supported from the basket of the larger loudspeaker.

It is a further object of the present invention to provide an improved method of assembling a loudspeaker system having at least one smaller loudspeaker mounted within a larger loudspeaker such that a series of subassemblies can be easily joined together and such that all necessary soldering of electrical connections is completed before final assembly.

It is still a further object of the present invention to provide an improved loudspeaker system having at least one smaller loudspeaker mounted within a larger loudspeaker such that the number of separate parts is substantially reduced and in which adhesive is substantially eliminated.

SUMMARY OF THE INVENTION

The present invention is directed to an improved loudspeaker construction. A number of separate features are included in this invention, and they can either be used together, as described below, or in any desired sub-combination.

A first feature of this invention relates to a novel manner for mounting a centering spider in place in a loudspeaker. According to this feature of the invention, the spider is clamped between first and second mounting members included in the loudspeaker. These mounting members clamp the perimeter region of the spider in place in order to locate the spider and hold it in place precisely with respect to the frame in a mechanical manner. The preferred embodiment described below utilizes a circular ridge which extends around the spider and forces the spider into a mating circular recess in order to enhance the clamping action. This feature of the invention provides a simple, mechanical way of mounting a spider in place which avoids the use of adhesives.

A second feature of this invention relates to a novel way for mounting a magnet assembly in place in a loudspeaker. According to this feature of the invention, a loudspeaker is provided with a frame which defines a first threaded surface, and a second threaded surface is coupled with the magnet assembly and shaped to mate with the first threaded surface to form a threaded coupling which secures the magnet assembly to the frame and holds the magnet assembly securely against a positioning surface defined by the frame. In the preferred embodiment described below the second threaded surface is defined by a cap which fits over the magnet assembly and in effect captures the magnet assembly between the cap and the frame. As set out in detail below, this feature of the invention provides a particularly simple and reliable means for holding a magnet assembly in place in a loudspeaker. Furthermore, the threaded coupling readily and automatically adjusts to variations in thickness in the magnet assembly.

A third feature of this invention relates to a novel structure for holding a surround (which is secured to a loudspeaker diaphragm) in place to a loudspeaker frame. According to this aspect of the invention, the surround is clamped in place to the frame between first and second clamping members. The second clamping member is held in place by an array of resilient locking fingers which are configured to move aside as the second clamping member moves into position against the first clamping member, and then to spring back to lock the second clamping member in place mechanically and automatically. In the preferred embodiment described below the second locking member is a ring which does not interfere with the use of centering jigs or fixtures during clamping of the surround. This feature of the invention allows the surround to be held in place mechanically without adhesives, without interfering with the use of centering jigs.

A fourth feature of this invention is directed to a novel terminal strap which is used to interconnect multiple speakers included in a two or a three-way speaker for example. According to this invention, a loudspeaker is provided with a terminal strap which defines first and second end sections, each of which defines at least one respective barb. The two end sections make electrical contact with a voice coil conductor and an additional speaker, respectively. The loudspeaker defines a frame which defines first and second passages, each positioned to receive a respective one of the first and second end sections. Each of these passages defines a respective wall positioned to engage a respective barb of the terminal strap. The passages and terminal strap are configured such that, when the terminal strap is pushed through the frame with the first and second end sections moving through the first and second passages, respectively, the first and second barbs engage the respective transverse walls to hold the terminal strap securely in the frame and thereby prevent audible resonance of the end sections during operation of the loudspeaker. In the preferred embodiments described below, later assembled parts which are mechanically mounted to the frame serve further to immobilize the ends of the terminal strap, and the central portion of the terminal strap is positioned so that it is spaced away from the frame, and therefore cannot resonate against the frame.

Another feature of this invention is the provision of a locating ring molded in place around a peripheral portion of a front plate of a loudspeaker magnet assembly. This locating ring serves to define a set of precisely positioned locating surfaces in order to allow the magnet assembly to be positioned precisely during assembly. It has been found that such a molded in place locating ring can be used to provide more precise external dimensions than can readily be obtained in conventional methods for forming the front plate of the magnet assembly.

Other important features of this invention relate to the grille and the manner in which the grille functions to support small speakers in front of the main speaker. One novel aspect of the grille described below is the use of locking fingers, each of which defines a respective locking surface configured to engage a second speaker in order to hold the second speaker securely in place mechanically against the grille, such that only mechanical forces are required to support the second speaker on the support surface. Another aspect of the grille of this invention relates a cantilevered tongue which extends out from a peripheral ring and is used to mount a second speaker in place over a first speaker. In order to provide adequate structural support for this cantilevered, speaker-bearing tongue, the embodiment described below utilizes a grille mesh which is rigidly secured to the grille and to the tongue to extend over the first speaker diaphragm. This grille mesh provides structural support to the cantilevered tongue to enable the tongue to support the second speaker properly. The use of locking fingers to hold the second speaker in place has been found to provide a simple, low-cost, trouble-free manner of assembling a second speaker onto a grille. The use of the grille mesh to provide structural support to a cantilevered, speaker-bearing tongue has been found to allow the use of a lighter weight, more flexible tongue, while still providing proper support to the speaker.

The invention itself, together with further objects and attendant advantages, will best be understood by reference to the following detailed description of the preferred embodiments taken in conjunction with the accompanying drawings.

BRIEF DESCRIPTION OF THE DRAWINGS

FIG. 4 is a sectional view of the first preferred embodiment of the present invention from the right side, taken along the line 4—4 of FIG. 1;

FIG. 7 is an enlarged sectional view of portions of the first preferred embodiment of the present invention taken along the line 7—7 of FIG. 3;

FIG. 18 is an exploded view of portions of the second preferred embodiment of the present invention showing elements of the magnet in relation to the basket;

FIG. 19 is an enlarged sectional view of portions of the basket of the second preferred embodiment of the present invention taken along the line 19—19 of FIG. 18;

FIG. 20 is an enlarged sectional view of portions of either the first or the second preferred embodiment of the present invention taken along the line 20—20 of FIG. 3 or the line 20—20 of FIG. 14;

FIG. 21 is an enlarged sectional view of portions of the second preferred embodiment of the present invention taken along the line 21—21 of FIG. 14;

FIG. 28 is a bottom view taken along line 28—28 of FIG. 23;

FIG. 29 is a perspective view of one of the terminal straps included in the loudspeaker of FIG. 22;

FIG. 30 is a cross sectional view taken along line 30—30 of FIG. 24;

DESCRIPTION OF THE PREFERRED EMBODIMENTS

Figure 2:
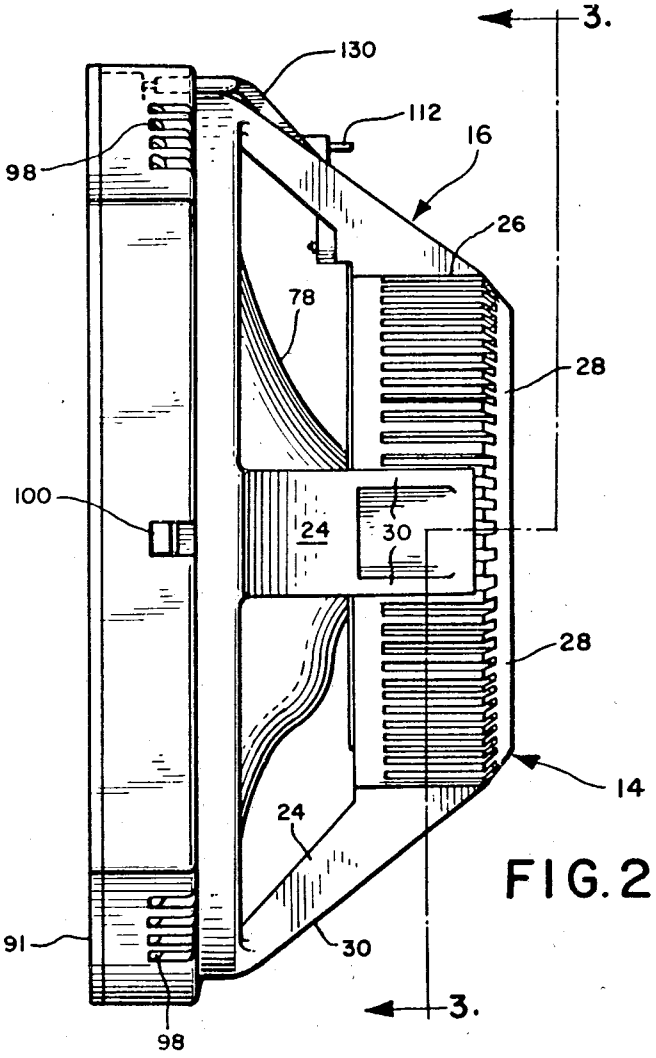
FIG. 2 is a right side elevation of the first preferred embodiment of the present invention.

In the drawing, FIGS. 1–13 show various views of a first preferred embodiment, FIGS. 14–21 show various views of a second preferred embodiment, and FIGS. 22–36 show various views of a third preferred emboidment. The following discussion will take up each of these three embodiments in turn.

The First Preferred Embodiment

Figure 1:
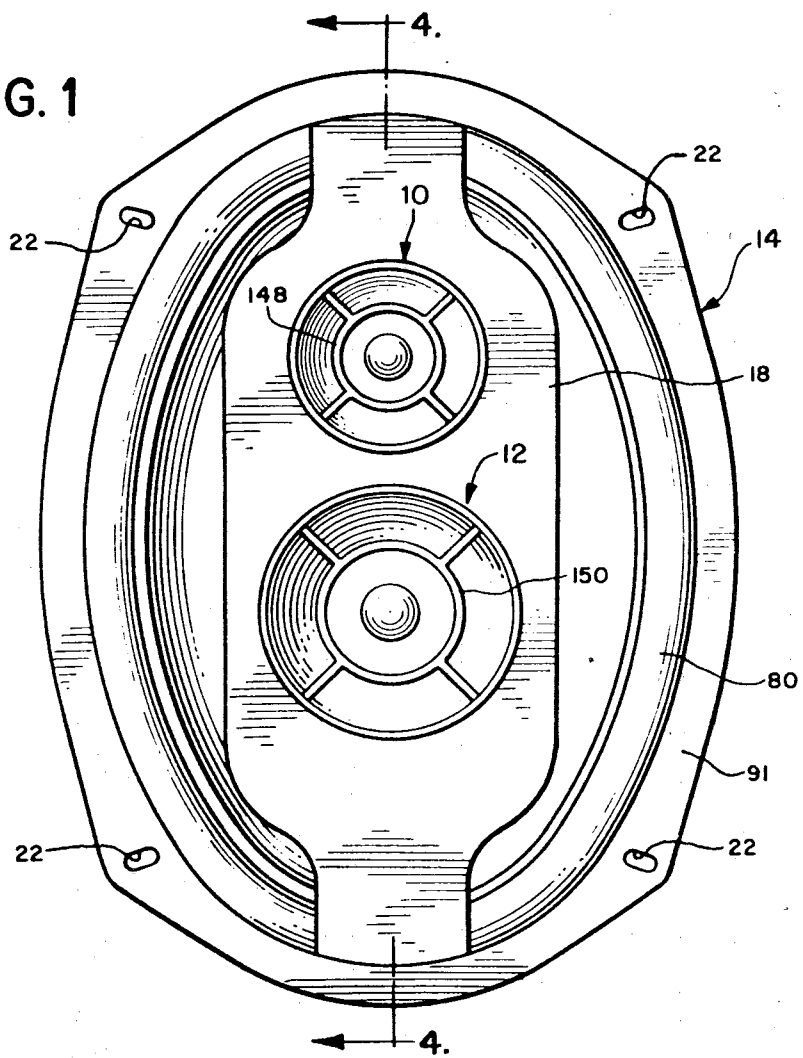
FIG. 1 is a front elevation of a first preferred embodiment of the present invention comprising a three-way loudspeaker system.

With reference to the drawings, a first preferred embodiment of a 3-way loudspeaker system made in accordance with the present invention is shown in FIGS. 1 through 13 and 20. The loudspeaker system comprises a tweeter, midrange, and woofer, indicated generally by the numerals 10, 12, and 14, respectively, as shown in FIGS. 1 and 2. The woofer 14 includes a molded basket, indicated generally by the numeral 16, which serves as a chassis for the loudspeaker system. The tweeter 10 and the midrange 12 are mounted within the woofer 14 upon a bridge 18.

Figure 3:
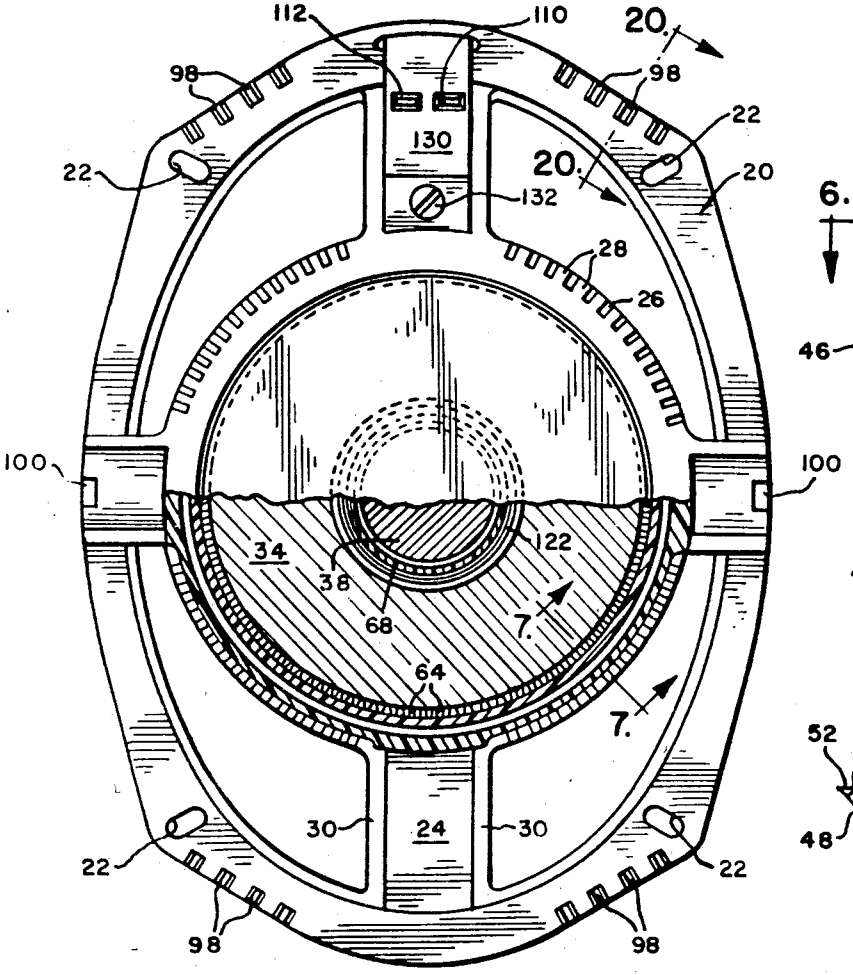
FIG. 3 is a rear view of the first preferred embodiment of the present invention, partially in section as indicated by the line 3—3 of FIG. 2.

The molded basket 16 of the woofer 14 includes a generally elliptical forward flange 20 which includes four mounting slots 22 spaced along the perimeter as shown in FIG. 3. Four angled legs 24 connect the forward flange 20 to a rearward cylindrical portion 26 which serves as a housing for the magnet of the woofer 14. The legs 24 have substantially radial ribs 30 to provide increased rigidity of the cylindrical portion 26. The surface of the cylindrical portion 26 of the molded basket 16 may be substantially smooth or may include surface details, for example, regularly spaced longitudinal ribs 28 as shown. The preferred material of the molded basket 16 is Noryl N300 as supplied by General Electric Company of Fairfield, Conn. However, other tough resilient plastics such as ABS may be used.

The magnet of the woofer 14, which is housed within the cylindrical portion 26 of the molded basket 16, includes a front pole plate 32, a ceramic magnetizable annular ring 34, and a rear pole plate 36, as shown in FIG. 4. A cylindrical pole piece 38 is fixed to the rear pole plate 36 so as to provide an annular gap 40 between the cylindrical pole piece 38 and the front pole plate 32 and the annular ring 34. The cylindrical pole piece 38 may include a shoulder 42 formed by reducing the diameter along the rearward circumference of the cylindrical pole piece 38, as shown, and may be fixed to the rear pole plate 36 by staking, by swaging, or by a pressed fit.

Figure 5:
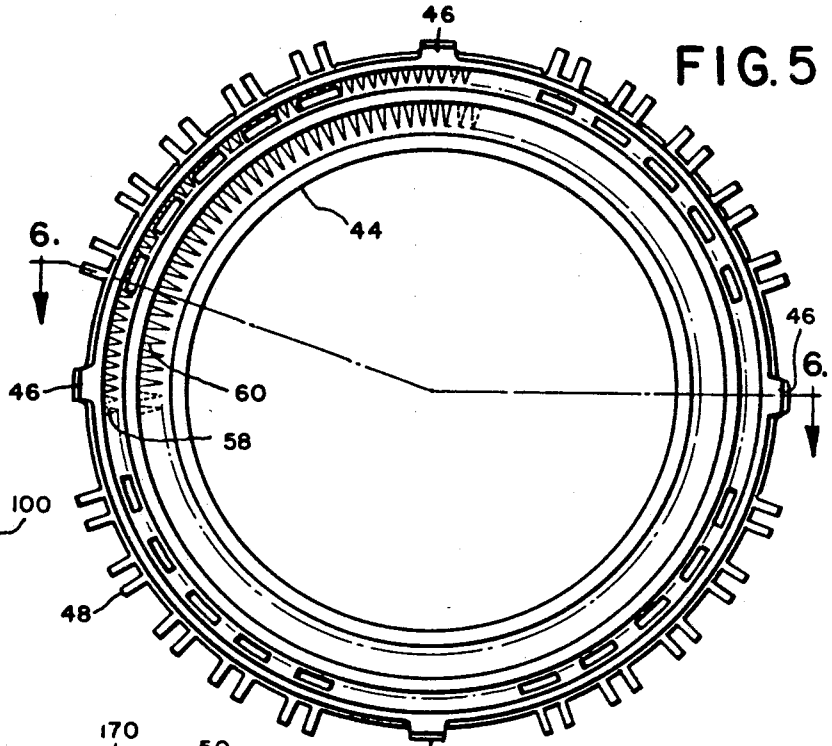
FIG. 5 is a rear view of the snap ring of the first preferred embodiment of the present invention.
Figure 6:
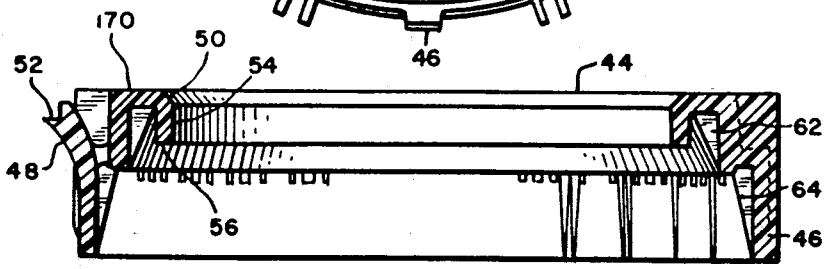
FIG. 6 is a sectional view of the snap ring of the first preferred embodiment of the present invention taken along the line 6—6 of FIG. 5.

The mounting of the elements of the magnet within the cylindrical portion 26 of the basket is accomplished by means of a snap ring 44 which is shown in FIGS. 5 and 6. The snap ring 44 includes four equally spaced alignment ribs 46 for engagement of corresponding channels in the molded basket 16. The snap ring 44 also includes regularly spaced pairs of resilient locking fingers 48 which are curved outward radially so as to engage the molded basket 16. The forward facing edge of the inside diameter of the snap ring 44 is beveled to form a chamfer 50 to provide clearance for the spider of the woofer 14, described below. The locking fingers 48 include notches or steps 52 which are aligned so as to provide substantially radial and longitudinal surfaces for providing positive location of the snap ring 44 with respect to the molded basket 16. The preferred material of the snap ring 44 is Noryl N300; however, other tough, resilient plastics such as ABS may be used.

The inside portion of the snap ring 44 includes a longitudinally extending annular flange 54 which terminates in a flat annular surface 56 for abutment with the front pole plate 32. The interior of the snap ring 44 also includes two annular rows 58 and 60 of deformable fins 62 and 64, respectively, which facilitate the alignment of the front pole plate 32 and the annular ring 34. Specifically, the fins 62 and 64 assist in centering the elements of the magnet within the cylindrical portion 26 of the molded basket 16 during assembly. The fins 62 and 64 provide an interference fit with the respective elements of the magnet. The crushing of the fins 62 and 64 about the front pole plate 32 and the annular ring 34 during assembly ensures that the elements of the magnet will not subsequently shift with respect to the molded basket 16, regardless of manufacturing variations in the diameter of the front pole plate 32 and annular ring 34.

The rear pole plate 36 is held in position against the annular ring 34 by a neoprene O-ring 66 which is positioned against an internal flange 68 of the cylindrical portion 26 of the molded basket 16. The O-ring 66 is compressed during assembly so as to contact and exert a constant loading force upon both the flat rearward portion of the rear pole plate 36 and the cylindrical side portion thereof. In this way, the O-ring 66 forces the front pole plate 32 against the flat annular surface 56 of the snap ring 44 to provide positive front to rear location of the front pole plate 32 relative to the molded basket. Similarly, the O-ring 66 forces the front pole plate 32 and the annular ring 34 into the fins 62 and 64, respectively, so as to cause crushing of the fins 62 and 64 during assembly of the woofer 14.

FIG. 7 shows the engagement of the basket 16 by the locking fingers 48. During assembly, the locking fingers 48 are bent inward as the outwardly curved portions thereof are forced past a cylindrical surface 72 of the basket 16. When the locking fingers 48 reach corresponding openings 74 in the cylindrical surface 72, the resilient locking fingers spring outward into the position shown in FIG. 7. The substantially longitudinal surfaces of the steps 52 thereupon engage the cylindrical surface 72, and the substantially radial surfaces of the step 52 engage the forward edges of the openings 74, thereby providing positive location of the snap ring relative to the molded basket 16. In practice, this assembly procedure is completed while a removable alignment fixture is inserted in the annular gap 40 between the cylindrical pole piece 38 and the front pole plate 32 and the annular ring 34 of the magnet. In this way, the fins 62 and 64 are crushed so as to form a tightly fitting pocket for maintaining the annular gap 40 after the alignment fixture is removed.

A cylindrical voice coil 68, movable axially within the annular gap 40, is supported by a nonconductive centering disc or spider 76 which is cemented or otherwise secured to the snap ring 44, as shown in FIG. 4. The spider 76 may be formed of stiffened fabric as described below and may include annular corrugations to facilitate axial movement of the voice coil relative to the front pole plate 32 and the annular ring 34. The chamfer 50 of the snap ring 44 provides clearance for the corrugations of the spider 76 to permit the voice coil 68 to move axially within the annular gap 40.

The voice coil 68 provides movement of an elliptical cone 78 which is cemented to the voice coil 68 about the apex, as shown in FIG. 4. The perimeter of the cone 78 is cemented to a foam surround 80 which includes a 180 degree curl presenting a convex surface toward the front of the loudspeaker. The periphery of the foam surround 80 is formed in a flat plane perpendicular to the axis of the magnet. The flat periphery of the foam surround 80 overlies a forwardly facing flange 81 of the molded basket 16.

Figure 8:
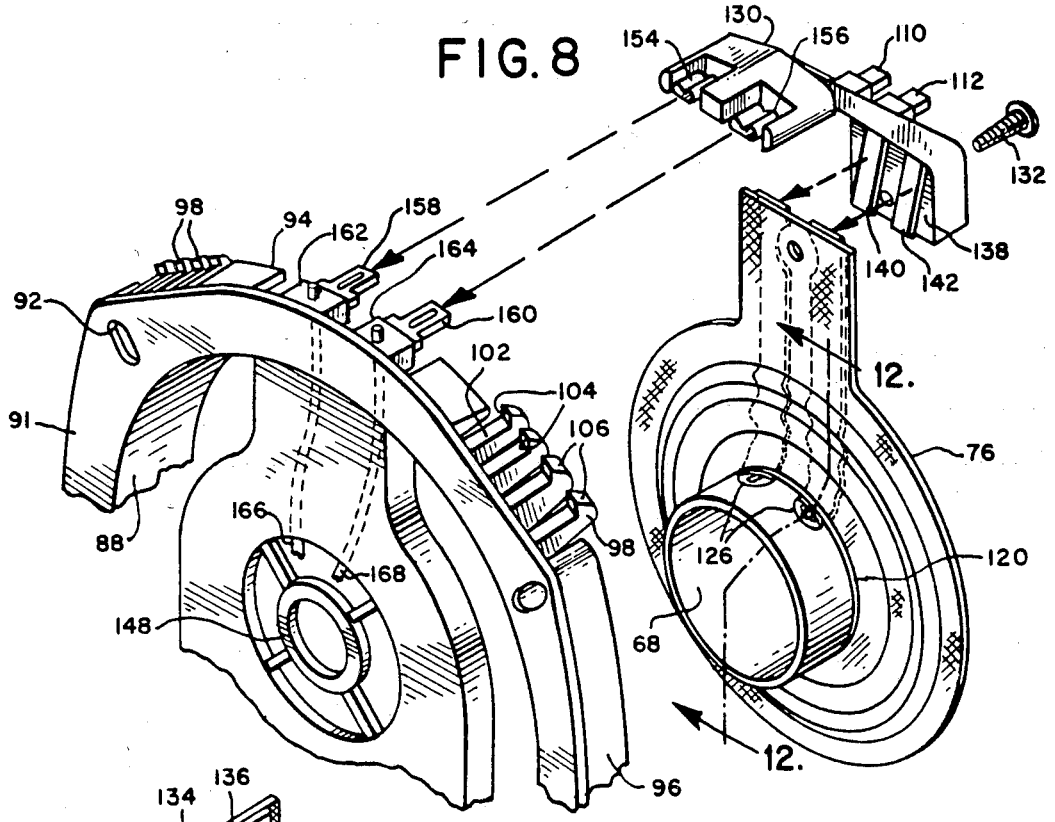
FIG. 8 is an exploded view of portions of the first preferred embodiment of the present invention showing the electrical connections.

The flange 81 of the molded basket 16 includes a groove 82 for receiving a tongue 84, as shown in FIG. 4. The tongue 84 is a rearward extension of an elliptical ring 88 which fits within a sidewall portion 90 of the forward flange 20 of the molded basket 16. The elliptical ring 88 is formed integrally with a face plate 91 which overlies the sidewall portion 90 of the molded basket 16 and which includes mounting slots 92 in alignment with the mounting slots 22 of the molded basket 16. As shown in FIGS. 4 and 8, end locating flanges 94 and side locating flanges 96 project rearward from the face plate 91 corresponding to the inside surfaces of the sidewall portion 90 to provide positive location of the elliptical ring 88. The preferred material for the elliptical ring 88 is Noryl N300; however, other tough resilient plastics such as ABS may be used.

The face plate 91 and the elliptical ring 88 are locked in position by resilient locking fingers 98 and 100 which are spaced along the perimeter of the face plate 91 in the spaces between the locating flanges 94 and 96, as shown in FIGS. 3 and 8. The number and placement of the locking fingers 98 and 100 are sufficient to provide a substantially uniform pressure of the tongue 84 against the groove 82 of the molded basket 16. In this way, the foam surround 80, which overlies the groove 82 so as to be captured by engagement of the tongue 84 with the groove 82, is securely held in place without being cut. The number and placement of the locking fingers shown, namely, four locking fingers 98 adjacent each mounting slot 92 and wider locking fingers 100 at the midpoints of the sides of the face plate 91, are merely illustrative.

The locking fingers 98 and 100 are angled slightly outward along stalk portions 102 in relation to the locating flanges 94 and 96 and include flat barb portions 104 which are substantially parallel to the face plate 91. The ends of the locking fingers 98 and 100 have beveled surfaces 106 which angle inward in the rearward direction to facilitate insertion of the elliptical ring 88 into the sidewall portion 90 of the molded basket 16. The beveled surfaces 106 engage substantially flat surfaces of the inside of the sidewall portion 90 so as to bend the locking fingers 98 and 100 inward during assembly. Openings 108 are formed in the sidewall portion 90 of the molded basket 16 corresponding to the location of the flat barb portions 104 and the beveled surfaces 106 so as to permit the locking fingers 98 and 100 to snap outward to the position shown in FIG. 20. Due to the slightly outward extension of the stalk portions 102 of the locking fingers 98 and 100 before assembly, the locking fingers 98 and 100 are biased outward against the inside of the sidewall portion 90 of the molded basket 16 in the assembled position so as to prevent undesired resonances.

Figure 11:
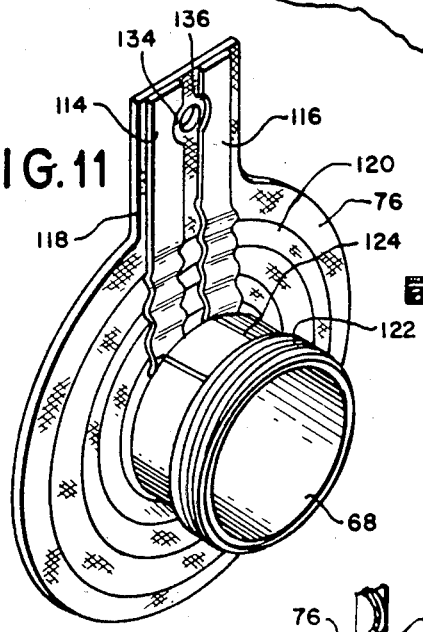
FIG. 11 is a perspective view of the spider and voice coil assembly of the first preferred embodiment of the present invention.

Electrical continuity between the voice coil 68 and two input terminals 110 and 112 is achieved by two conductive strips 114 and 116, respectively, formed upon the spider 76 and upon a radially extending tab 118 formed integrally with the spider 76, as shown in FIG. 11. In forming the conductive strips 114 and the spider 76, a limp cotton cloth is first impregnated with a thermal setting resin, dried, and bolted. The preferred impregnated material is W140 as supplied by Nu-Way Speaker Products, Inc. of Antioch, Ill., U.S.A. Other types of cloth such as muslin or other fibrous material such as a mat made of randomly arranged fibers could, alternatively, be used to form the blank.

The "pre-pregged" cloth blank is then silk screened with a conductive ink to the contour of the desired conductive strips 114 and 116. Applicant has found that conductive compounds C-929-91 and C-210-2 as supplied by Amicon Corporation of Lexington, Mass., U.S.A. are particularly well suited for this use. For the first application, compound C-929-91, a premixed dilute solution containing silver particles, is used to penetrate through the pre-pregged cloth blank and thoroughly coat the fibers thereof. Compound C-210-2, a thicker, paste-like solution having 68 percent silver particles by weight, is silk screened over the first application of conductive ink along the same desired contours of the conductive strips 114 and 116. Applicant has found that this two-step application of the conductive ink locks the conductive strips to the fabric of the spider 76 to prevent cracking or peeling and results in improved conductivity of the conductive strips 114 and 116.

The next step in the formation of the spider 76 and conductive strips 114 and 116 is the thermal forming of the pre-pregged and silk screened blank. The cloth is pressed in a heated fixture to a temperature of 480–500 degrees Fahrenheit (248°–260° C.) at 900 pounds (63.276 kg) per square inch (sq. cm) for 10 seconds so as to form a series of concentric corrugations 119 and a rolled flange or skirt 120 having the conductive strips 114 and 116 along an inside diameter corresponding to the diameter of the voice coil 68. During this thermal forming, the metallic particles of the conductive ink, which are initially substantially spherical balls, are advantageously altered. It is Applicant's belief that the metallic particles are flattened from the substantially spherical balls into pancake like particles aligned substantially with the plane of the blank. These flattened metallic particles are more intimately in contact with each other and with the fibers of the blank.

The altering of the metallic particles overcomes the prior art problems of poor electrical conductivity of the conductive strips 114 and 116 and inadequate bonding of the conductive strips 114 and 116 to the spider 76. In addition, the thermal forming overcomes problems related to soldering. Soldering of more conventional conductive strips has not been possible because of the tendency of the substantially spherical balls of the conductive ink to "run" from the soldering tip once a soldering temperature is reached. Applicant applies sufficient heat and pressure to alter the spherical balls sufficiently to permit soldering. The temperature and pressure ranges required will be dependent upon the particular conductive ink and the material of the blank used, hence the temperature and pressures listed herein are merely illustrative.

The voice coil 68 includes a double layer of insulated windings 122 from which two insulated wire leads 124 extend longitudinally along the outer surface of the voice coil 68. The two leads 124 are spaced apart at a distance corresponding to the spacing of the conductive strips 114 and 116 and overlie a pair of circular holes 126 punched through the voice coil 68. The windings 122 and the two leads 124 may conveniently be cemented to the voice coil 68, and the cylindrical tube of the voice coil 68 may be conveniently formed of a paper or fiber reinforced synthetic material. During assembly, the voice coil 68 is placed in a fixture such that one end of the voice coil 68 protrudes. The spider 76 is then forced over the free end of the voice coil 68 into contact with the fixture such that the windings 122 are spaced a predetermined distance from the spider 76 and away from the skirt 120. A cement is then applied between the spider 76 and the voice coil 68 from the side of the spider 76 corresponding to the end of the voice coil 68 having the windings 122.

An electrical connection is effected between the conductive strips 114 and 116 and the two leads 124 of the voice coil 68 by carefully following a series of steps. First, the assembled spider 76 and the voice coil 68 are inverted from the position shown in FIGS. 8 and 11 to a position in which the holes 126 and the tab 118 are directed downward. The free ends of the two leads 124 are then pulled through the holes 126 and away from the windings 122 in a longitudinal direction and outward so as to force the leads 124 tightly against the conductive strips 114 and 116. The two leads 124 are then carefully soldered to the conductive strips 114 and 116 by using a temperature controlled soldering iron with the tip maintained between 426 and 445 degrees Fahrenheit (218°–229° C.). Although other solders containing silver may be used, Applicant has found that a satisfactory soldered connection can be conveniently and economically made using standard 60/40 radio-TV solder with a resin core. The two leads 124 are insulated with Strip-Ease enamel which eliminates the need for stripping before soldering. After soldering, the free ends of the two leads 124 are clipped adjacent the skirt 120 of the spider 76 and a dust cover 128 is cemented to the inside of the voice coil 68, as shown in FIG. 4.

Figure 10:
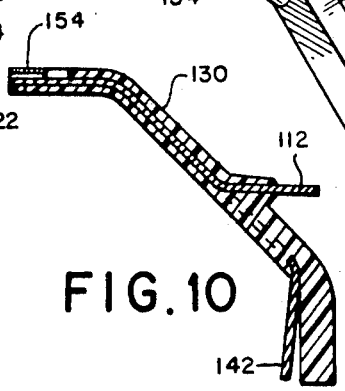
FIG. 10 is a sectional view of the terminal module of the first preferred embodiment taken along the line 10—10 of FIG. 9.
Figure 9:
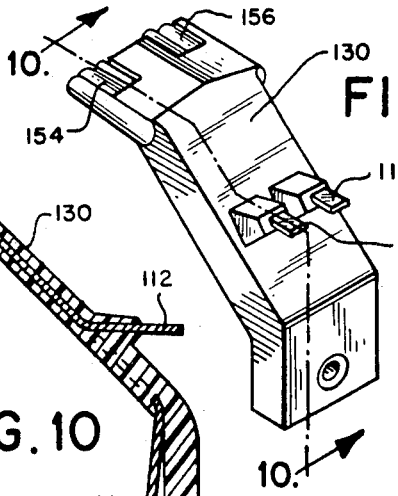
FIG. 9 is a perspective view of the terminal module of the first preferred embodiment of the present invention.
Figure 12:
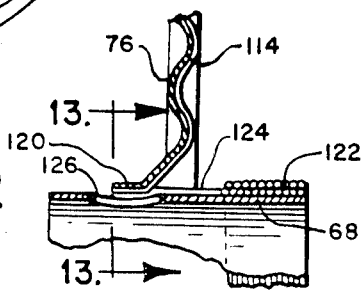
FIG. 12 is an enlarged sectional view of portions of the spider and voice coil assembly of the first preferred embodiment of the present invention taken along the line 12—12 of FIG. 8.
Figure 13:
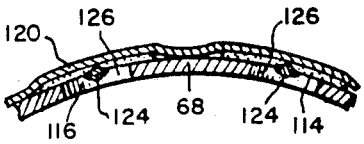
FIG. 13 is an enlarged sectional view of portions of the spider and voice coil assembly of the first preferred embodiment of the present invention taken along the line 13—13 of FIG. 12.

The input terminals 110 and 112 are embedded within a terminal module 130 which is secured to the molded basket 16 from the rear by a screw 132. The conductive strips 114 and 116 include notches 134 and 136 to ensure that the screw 132 does not form a short circuit between the conductive strips 114 and 116. In the preferred embodiments shown, the input terminals 110 and 112 are struck from tin plated strips of brass which are embedded within the terminal module 130. At the rearward end of the terminal module 130, the tin plated brass strips protrude from the terminal module 130 and are angled forward of a flat rearward portion 138 of the terminal module 130 so as to form two spring contacts 140 and 142 as shown in FIGS. 8 and 10. At an intermediate point along the terminal module 130, the tin plated strips of brass protrude as the terminals 110 and 112. The terminal module 130 may be molded of Noryl N300, ABS, or other tough non-conductive plastic.

During assembly of the woofer 14, the tab 118 of the spider 76 is guided through a narrow slot 143 in the molded basket 16 adjacent to the cylindrical portion 26, as shown in FIG. 4. In that position, the tab 118 overlies a flat portion 144 of the molded basket 16 which is perpendicular to the axis of the magnet of the woofer 14. As the screw 132 is threaded into a hole 146 in the flat portion 144, the spring contacts 140 and 142 are biased by their resiliency against the conductive strips 114 and 116, respectively, to ensure that positive electrical contact is made and maintained.

In addition to the woofer 14 which has been described, the first preferred embodiment includes the tweeter 10 and the midrange 12 which are mounted within the woofer 14 upon the bridge 18. As best shown in FIGS. 4 and 8, the bridge 18 may be formed integrally with the face plate 91 and the elliptical ring 88. The bridge 18 may include a tweeter grille 148 and a midrange grille 150 and may also include split mushroom type fixing studs 152 or similar mounting devices for the tweeter 10 and the midrange 12. The tweeter 10 and the midrange 12 may be of conventional design or may be scaled down replicas of the woofer 14 previously described. The midrange 12 shown in FIG. 4 has a construction following the second preferred embodiment described below.

The electrical connection between the tweeter 10 and the midrange 12 with the input terminals 110 and 114 is effected conveniently by the installation of the terminal module 130 previously described. The strips of tin plated brass from which the input terminals 110 and 112 are struck protrude forward from the terminal module 130 parallel to the axis of the magnet of the woofer and are rolled so as to form female connectors 154 and 156. The female connectors engage two complementary tab terminals 158 and 160, respectively, protruding from flanges 162 and 164 which extend rearward from the face plate 91 through a slotted opening 164 within the forwardly facing flange 82 of the molded basket 16. The tab terminals 158 and 160 may be pinch terminals of conventional design or may be terminals of Applicant's own solderless connection design. The wires 166 and 168 are connected to the tweeter 10 and the midrange 12 through a conventional crossover network, not shown.

It will be noted that the final assembly of the 3-way loudspeaker system shown in FIGS. 1 through 13 and 20 can be easily effected without the need for solder or adhesive after the various subassemblies are formed. Namely, at the time of final assembly, the tweeter 10, the midrange 12, the crossover network, not shown, the wires 166 and 168, and the tab terminals 158 and 160 are preassembled to the face plate 91 which is formed integrally with the elliptical ring 88 and the bridge 18. Further, at the time of final assembly, the foam surround 80, the cone 78, the spider 76, the conductive strips 114 and 116, the dust cover 128, and the voice coil 68 are preassembled to form a subassembly.

During final assembly, the speaker basket 16 is oriented such that the cylindrical portion 126 is downward and the flange 82 of the molded basket 16 is directed upward. In this orientation, the O-ring 66 is laid in position as shown in FIG. 4, and the elements of the magnet of the woofer 14 are laid over the O-ring 66 and are locked in place by the snap ring 44 as previously described. The tab 118 of the spider 76 is then inserted through the slot 143 of the molded basket 16, and the annular perimeter of the spider 76 is cemented to the normally forward flat surface 170 of the snap ring 44. The subassembly including the face plate 91 is then snapped into the assembled position shown in FIG. 20 so as to capture and secure the perimeter of the foam surround 80. The female connectors 154 and 156 of the terminal module 130 are then forced over the tab terminals 158 and 160, and the screw 132 is inserted through the terminal module 130 and is threaded into the hole 146 to secure the terminal module 130 in place. Thus, the final assembly requires no threading of flexible leads through a loudspeaker cone, requires no delicate soldering, and requires no curing of an adhesive.

The Second Preferred Embodiment

A second preferred embodiment of the present invention is shown in FIGS. 14 through 21, in which similar elements are designated by the same numerals used with respect to the first embodiment in FIGS. 1 through 13. Specifically, the second preferred embodiment utilizes an alternative snap ring 172 in place of the snap ring 44 of the first preferred embodiment and utilizes an alternative molded basket 174 adapted to receive the snap ring 172. All other elements of the second preferred embodiment are unchanged from those of the first preferred embodiment previously described. The preferred material for the snap ring 172 and the molded basket 174 is Noryl N300; however, other tough, resilient plastics such as ABS may be used.

Figure 16:
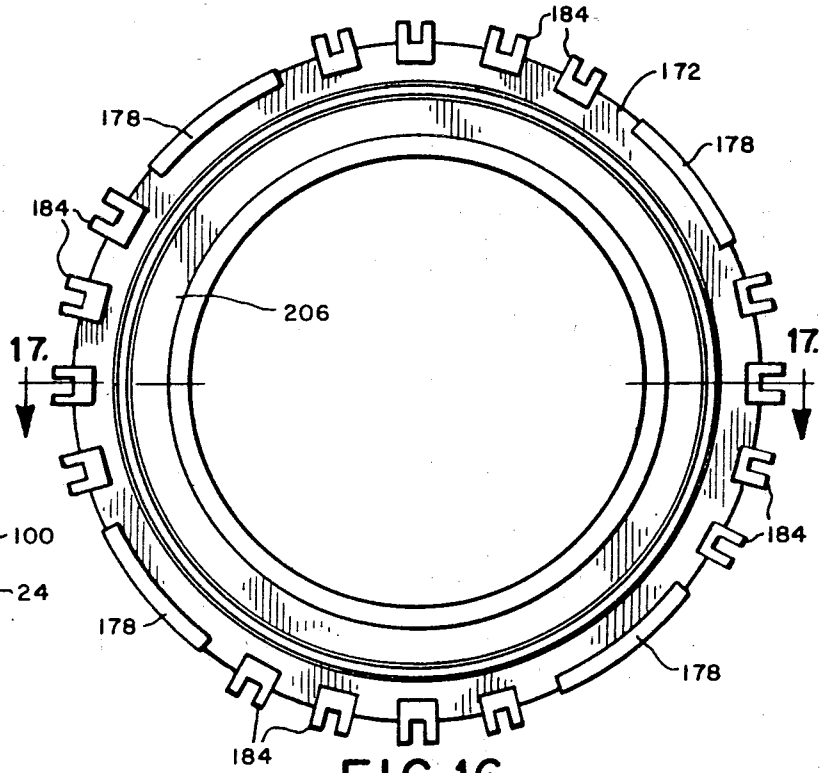
FIG. 16 is a rear elevation of the snap ring of the second preferred embodiment of the present invention.
Figure 17:
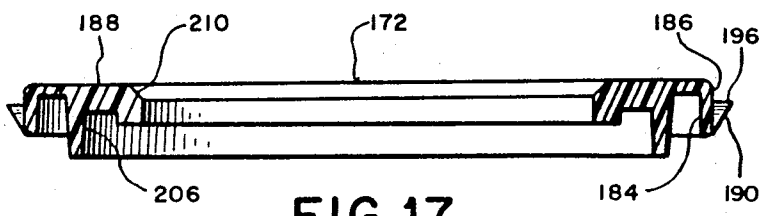
FIG. 17 is a sectional view of the snap ring of the second preferred embodiment of the present invention taken along the line 17—17 of FIG. 16.
Figure 14:
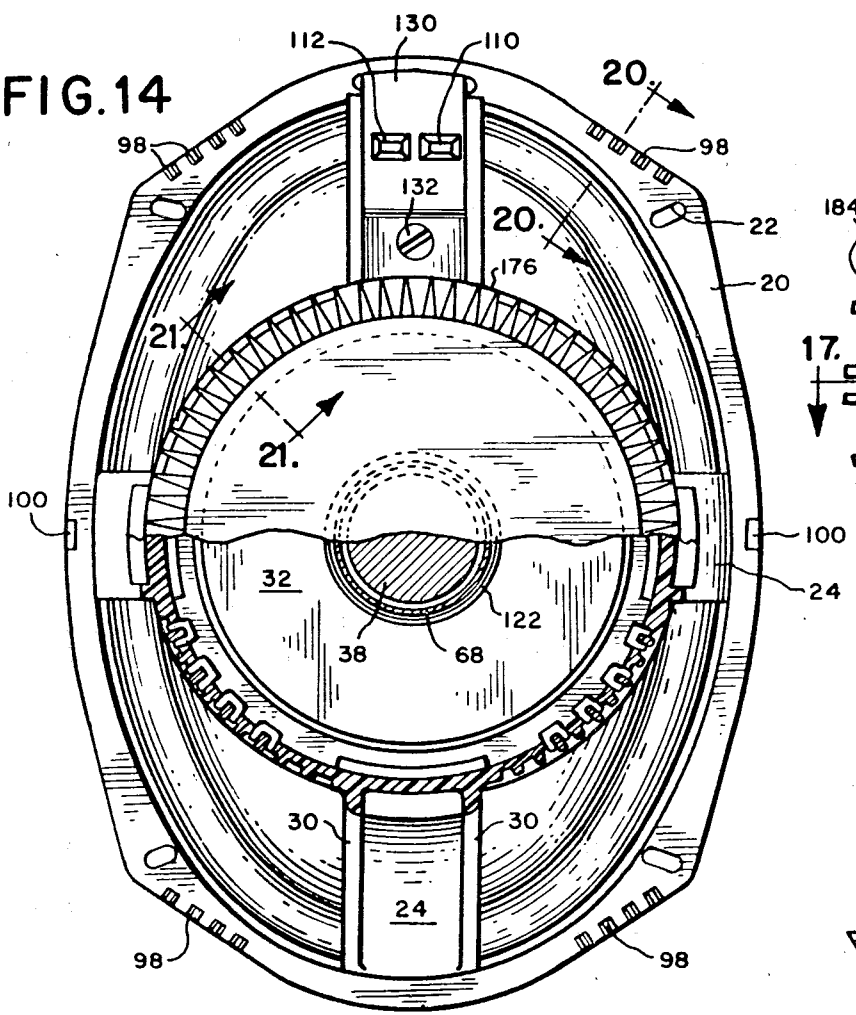
FIG. 14 is a rear view of a second preferred embodiment of the present invention, partially in section as indicated by the line 14—14 of FIG. 15.
Figure 15:
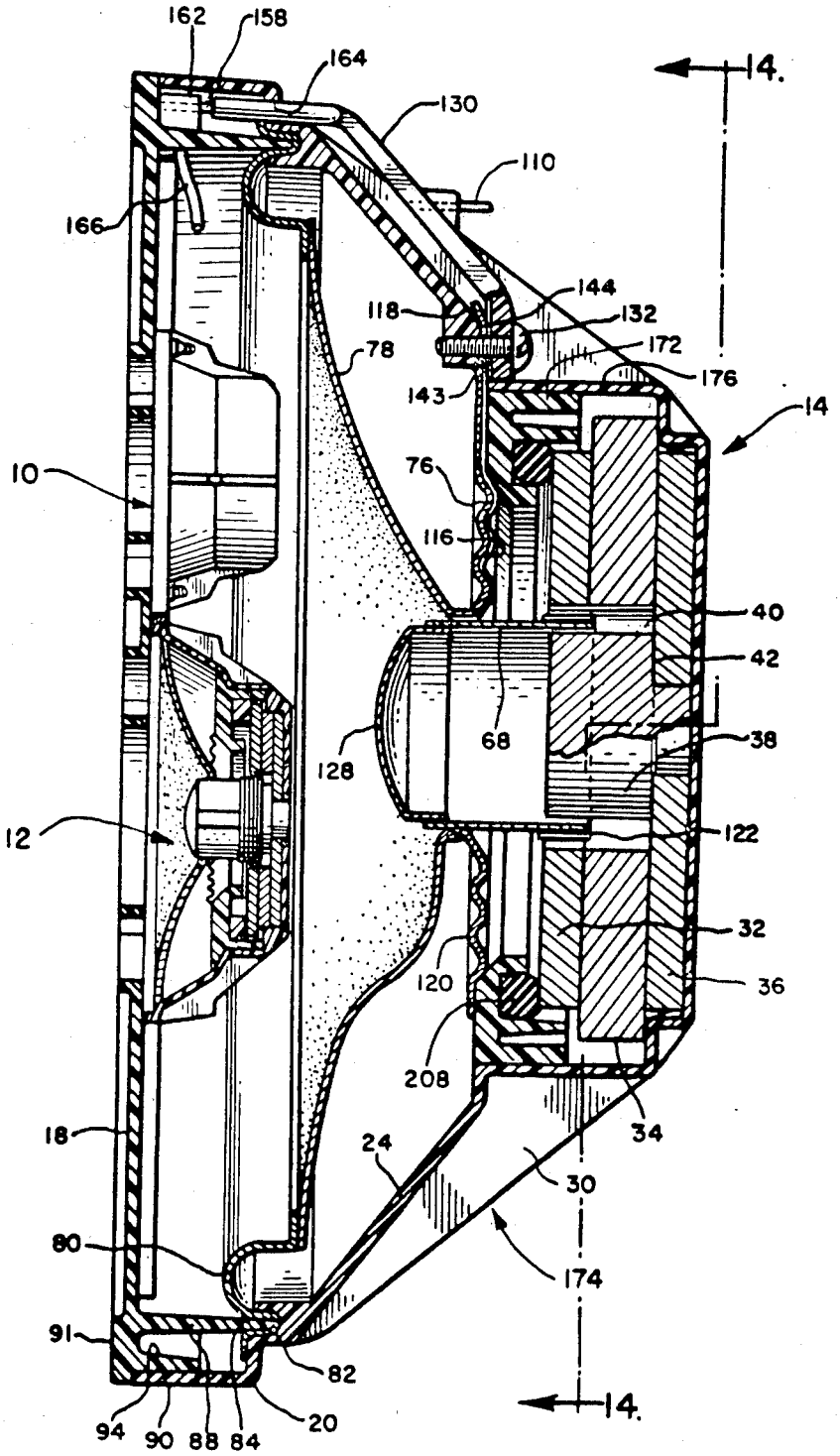
FIG. 15 is a sectional view of the second preferred embodiment of the present invention, as viewed from the right side analogous to FIG. 4.

In the second preferred embodiment, the elements of the magnet are mounted within a cylindrical portion 176 of the molded basket 174 by means of the snap ring 172 as shown in FIGS. 15 and 21. The snap ring 172 includes four equally spaced alignment ribs 178 which protrude radially for engagement of corresponding channels 180 formed between locating flanges 182 of the molded basket 174 as shown in FIGS. 16 and 18, respectively. The snap ring 172 also includes regularly spaced pairs of resilient locking fingers 184 which include stalk portions 186 which extend rearward from a flat annular surface 188, as shown in FIG. 17, to permit flexing of the locking fingers 184. The locking fingers 184 include striking portions 190, as shown in FIG. 18, for directing the locking fingers 184 into a cylindrical cavity 192 of the molded basket 174.

A series of rectangular openings 194 is spaced within the cylindrical cavity 192 so as to correspond to the locking fingers 184. The rectangular openings 194 receive the striking portions 190 when the snap ring 172 is pressed into the molded basket 174 to its assembled position, as shown in FIG. 21. The striking portions 190 of the locking fingers 184 form an interference fit with the cylindrical cavity 192. Due to the resiliency of the locking fingers 182, the locking fingers 182 are deflected radially inward during assembly, causing flexing of the stalk portions 186. Flat barb portions 196 engage the forward ends of the rectangular openings 194 to lock the snap ring in position when the locking fingers snap outward upon reaching their assembled positions.

Unlike the first preferred embodiment, alignment of the elements of the magnet is provided by two annular rows 198 and 200 of deformable fins 202 and 204, respectively, formed within the molded basket 174, as shown in FIGS. 18 and 19. (In contrast, the annular rows 58 and 60 of deformable fins of the first preferred embodiment were upon the snap ring 44 rather than upon the molded basket 16.) The fins 202 and 204 provide an interference fit with the annular ring 32 and the rear pole plate 36, respectively, of the magnet. The snap ring 172 includes no alignment fins but includes an annular channel 206 for receiving a neoprene O-ring 208. The O-ring 208 is concentric with the elements of the magnet and has a diameter such that it contacts both the flat forward surface and the cylindrical side surface of the front pole plate 32 when the magnet is mounted within the molded basket 174, as shown in FIG. 21. As with the first preferred embodiment, the snap ring 172 includes a chamfer 210 to provide clearance for the spider 76.

During assembly of the second preferred embodiment, a fixture is positioned within the annular gap 40 before the elements of the magnet and the snap ring are mounted within the molded basket 174. As the snap ring 172 is pressed into its assembled position shown in FIGS. 15 and 21, the O-ring 208 forces the annular ring 34 and rear pole plate 36 to their seated positions against an internal shoulder 210 and a rear wall surface 212, respectively. The fins 202 and 204 assist in centering the elements of the magnet and are crushed around the cylindrical side surfaces of the annular ring 34 and rear pole plate 36, respectively, during assembly. The crushed fins 202 and 204 thus form a pocket around the elements of the magnet to prevent shifting of the annular ring 34 and rear pole plate 36 after removal of the fixture from the annular gap 40. The crushing of the fins 202 and 204 ensures that a tightly fitting pocket will be formed about the annular ring 34 and rear pole plate 36 regardless of manufacturing defects in the diameters thereof. Note that the assembled position of the snap ring 172 leaves a small space between a flat annular surface 214 of the snap ring 172 and the front pole plate 32. Unlike the first preferred embodiment, the axial location of the magnet relative to the spider 76 is fixed by the seating of the annular ring 34 and the rear pole plate 36 against the annular shoulder 210 and rear wall surface 212, respectively.

The loudspeaker construction and method of assembly of the present invention is not limited to one particular size of loudspeaker. As shown in FIG. 4, the midrange 12 of the 3-way loudspeaker system may have a construction similar to the woofer 14 of the second preferred embodiment. The midrange 12 includes a molded basket 216 which includes reinforcing ribs 218 and mounting ears with mounting holes for engagement of the fixing studs 152. A snap ring 220 locks the elements of the magnet 222 in position against the rear of the molded basket 216. Deformable fins are formed in the molded basket 216 in an interference relationship to the elements of the magnet 222 so as to be crushed during assembly. A resilient tension ring 224 may have a rectangular cross section instead of the round cross section of the O-ring 208 used in the woofer 14. A cone 226, a voice coil 228, and a spider 230 of the midrange 12 may be similar to those of the woofer 14 or may be of a more conventional construction.

An important feature of the present invention, as illustrated by either of the preferred embodiments, is that leakage of the magnetic flux from the annular gap is virtually eliminated due to the extensive use of plastic. This results in increased flux and more uniform flux within the annular gap for superior acoustical performance of the loudspeaker. This extensive use of plastic also results in reduction or even elimination of "ringing" common in many loudspeakers having metal components.

A second feature of the present invention is the enclosing of the magnet by the molded basket, the snap ring, and the spider. In this way, the elements of the magnet are protected from chipping or other damage. Further, the relatively unsightly elements of the magnet are hidden from view, and superficial manufacturing defects in the elements of the magnet are no longer a problem.

Another feature of the present invention is that an improved flexible electrical connection between the voice coil and the terminals supported from the speaker basket is provided. The conductive strips upon the spider eliminate the soldered braided leads which are a major source of loudspeaker failure and which may cause spurious sounds.

Another feature of the present invention is the elimination of labor intensive operations. By replacing the soldered braided leads with the conductive strips, by combining several components of conventional loudspeakers into single integrated units, and by simplifying assembly steps, the quality of the loudspeaker is more uniformly maintained and costs of manufacture are reduced. Applicant has determined that the 3-way loudspeaker systems of the preferred embodiments have only 21 elements in contrast to the 42 elements of a similar 3-way loudspeaker system of conventional construction.

Another feature of the present invention is the substantial elimination of adhesives in the final assembly of a loudspeaker system. The fixing of the elements of the magnet and the fixing of the foam surround of the cone by snap-together plastic components simplifies assembly and eliminates the need for a time consuming curing of adhesive, thereby reducing manufacturing costs.

From the foregoing, it should be apparent that an improved loudspeaker construction and a method of assembly therefor have been disclosed. This construction offers the advantages of extensive use of plastic, reduction in the number of components, and a more pleasing and variable appearance. The acoustical performance of the loudspeaker is enhanced and a major source of loudspeaker failure is eliminated. Additionally, assembly is greatly simplified and cost of manufacture is significantly reduced.

Individual features disclosed herein may be utilized alone or in various combinations in loudspeakers using conventional components. For example, a multiple loudspeaker system may include the bridge subassembly of the present invention in combination with a conventional loudspeaker basket and a conventional method of fixing the elements of the magnet. Similarly, the method of the present invention of fixing the elements of the magnet may be included in a loudspeaker having conventional lead wires in place of the conductive strips. Further, the capturing of the surround of the loudspeaker cone by a lock member or, alternatively, the including of conductive strips within the centering disc may be used in otherwise conventional loudspeakers. Other unlisted combinations would also realize one or more advantages of the features of the present invention.

The Third Preferred Embodiment

FIGS. 22–36 illustrate the third preferred embodiment of this invention.

Figure 22:
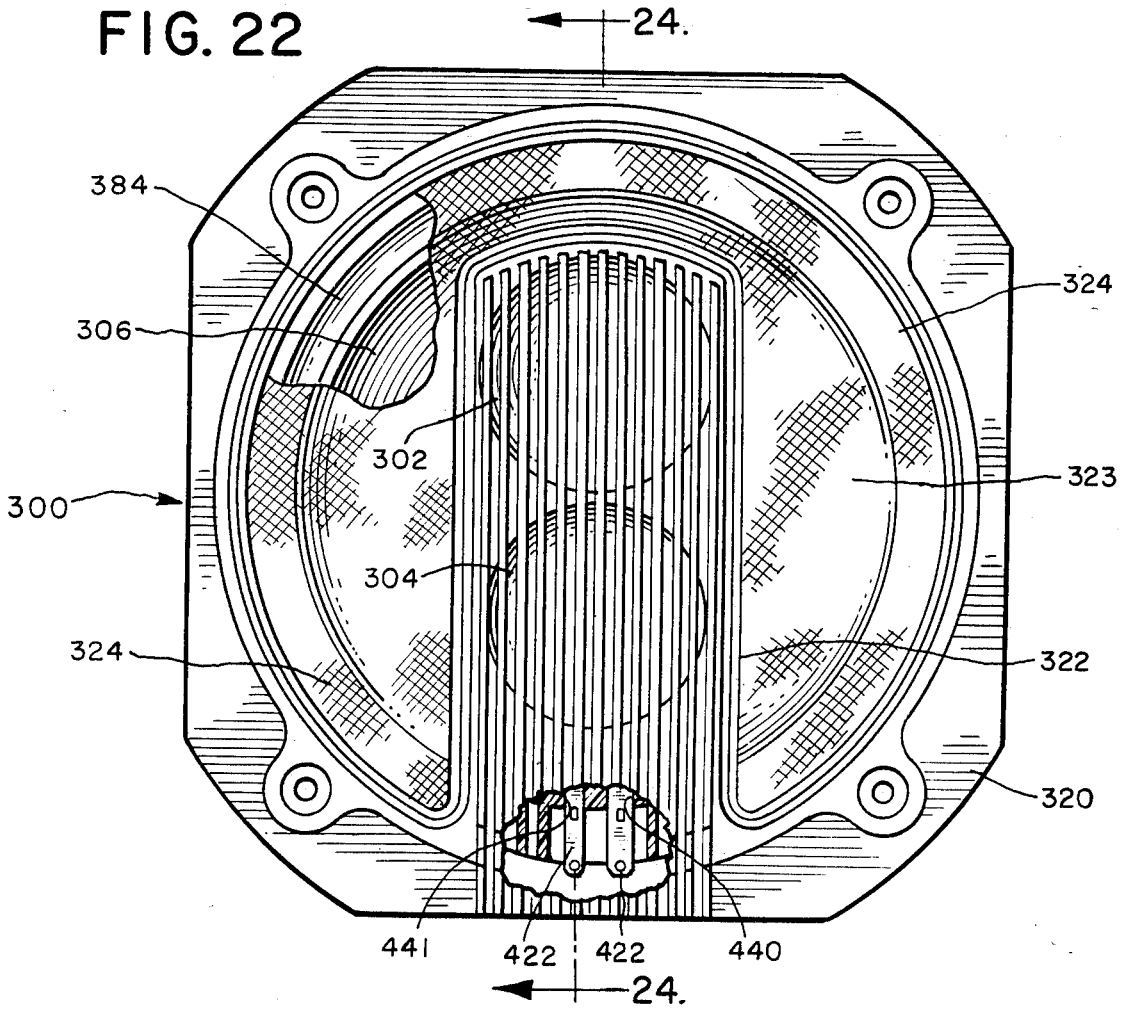
FIG. 22 is a front view of a loudspeaker which incorporates a third preferred embodiment of this invention.
Figure 23:
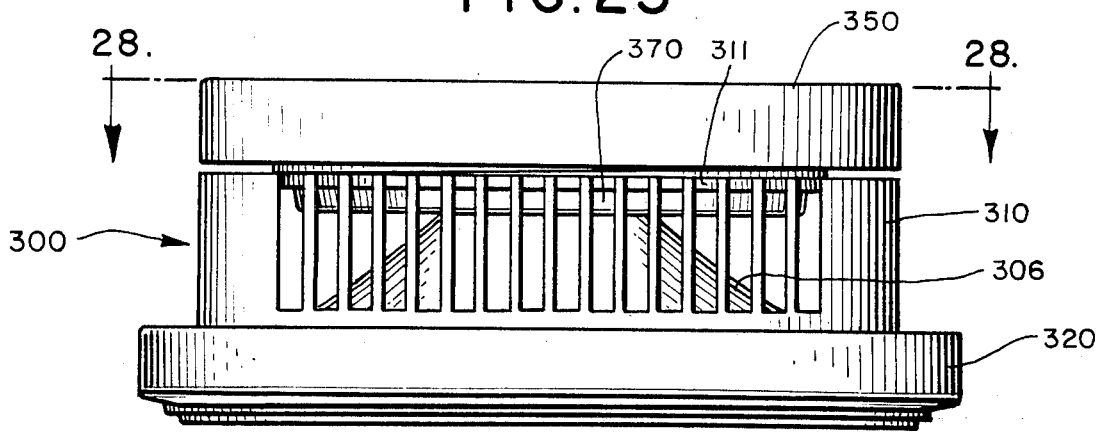
FIG. 23 is a side view of the loudspeaker of FIG. 22.

As shown generally in FIGS. 22 and 23, this third embodiment is a three-way loudspeaker 300 which includes a midrange speaker 302, a tweeter 304, and a woofer diaphragm 306. As will be explained below in greater detail, the woofer diaphragm 306 is mounted within a plastic frame 310, and the midrange 302 and tweeter 304 are mounted to a cantilevered tongue 322 included in a grille 320 which is secured in place to the frame 310. A metal grille mesh 324 is positioned around the cantilevered tongue 322 so as to support the tongue 322 in place, as described below.

As best shown in FIGS. 24—27, the loudspeaker 300 includes a magnet assembly 330. This magnet assembly 330 is formed of an annular magnet 332 which is adhesively bonded at each axial face to a front plate 334 and a rear plate 336. A central pole piece 338 is adhesvely bonded to the rear plate 336 so as to extend up through the central openings of the magnet 332 and the front plate 334.

The magnet assembly 330 is a conventional, prior art assembly except for the provision of a plastic ring 340. This ring 340 is insert molded to the front plate 334 so as to extend around the perimeter of the front plate 334. The ring 340 defines a precisely positioned circular perimeter 342 which can be maintained at a more precise diameter than that of the front plate 334. A ridge 344 extends in substantially a complete circle around the ring 340. In addition, the ring 340 defines three radially extending lugs 346 and an axially extending locating stud 348.

A cap 350 defines a set of internal threads 352 and an annular bearing surface 354. This bearing surface 354 is configured to engage the outer portion of the magnet 332. The frame 310 defines a set of external threads 316 shaped to mate with the internal threads 352. In addition, the frame 310 defines a spider locating ring 311. This ring 311 defines a positioning surface 312, and the positioning surface 312 defines an annular groove 314. This groove 314 is shaped to overlie and mate with the circular ridge 344. In addition, the spider ring 311 defines an opening (not shown) positioned and shaped to receive the locating stud 348.

Figure 24:
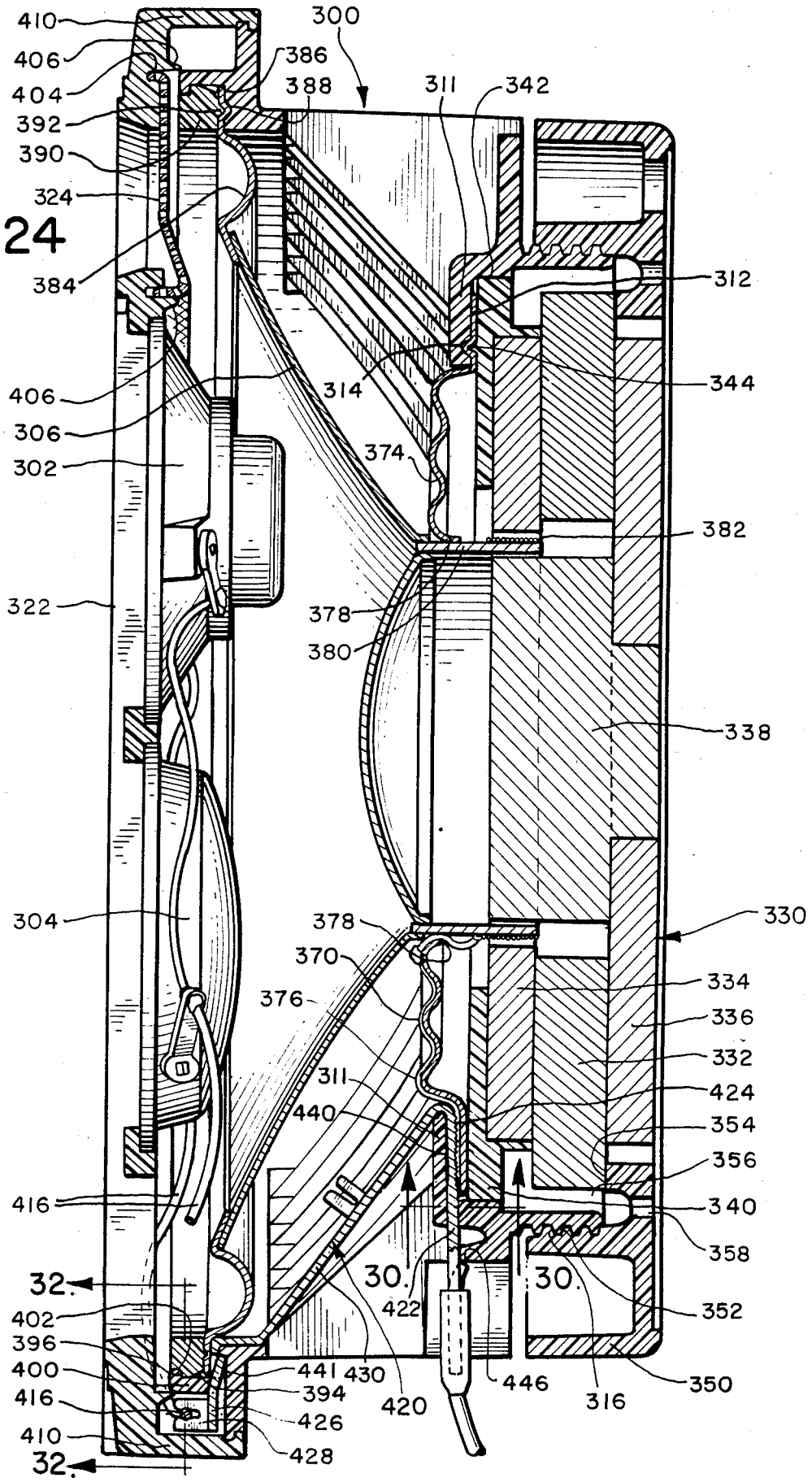
FIG. 24 is a cross sectional view taken along line 24—24 of FIG. 22.
Figure 25:
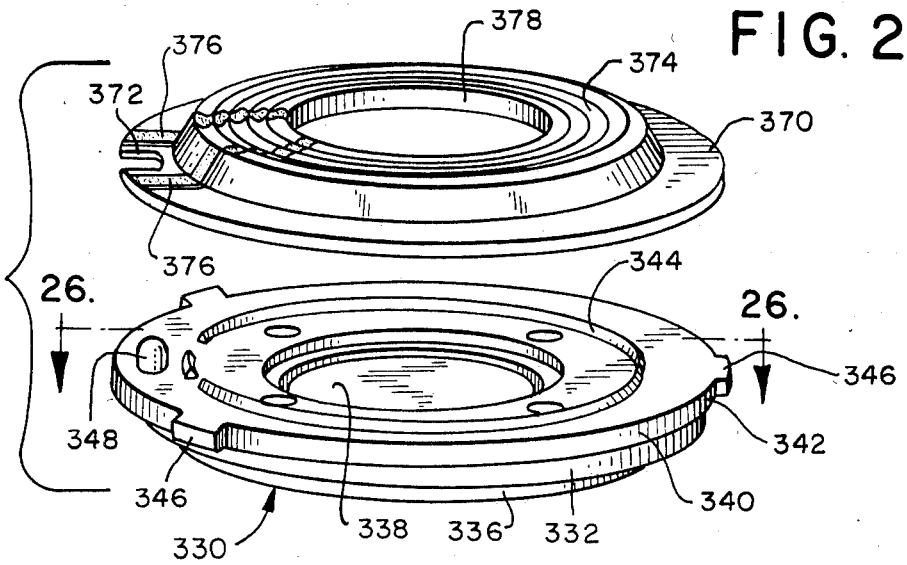
FIG. 25 is an exploded perspective view of the magnet assembly and spider of the loudspeaker of FIG. 22.
Figure 26:
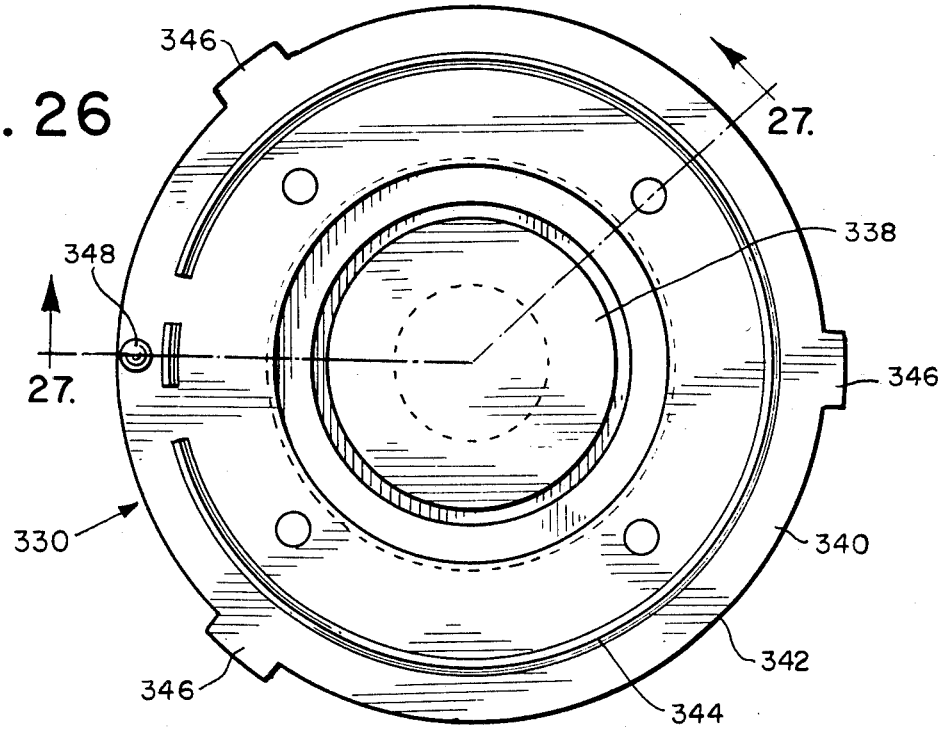
FIG. 26 is a plan view taken along line 26—26 of FIG. 25.
Figure 27:
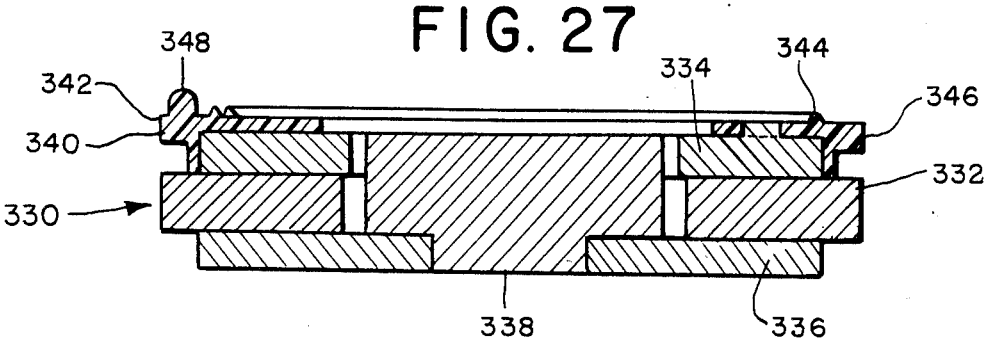
FIG. 27 is a cross sectional view taken along line 27—27 of FIG. 26.

As best shown in FIGS. 24 and 25, the loudspeaker 300 also includes a spider 370. This spider 370 is similar in many ways to the spider described above in conjunction with the first preferred embodiment. The spider 370 defines a locating hole 372 and an array of concentric corrugations 374. Two conductors 376 extend from the outer perimeter of the spider 370 to the central opening 378. These conductors 376 are preferably formed by the methods described above in conjunction with the first preferred embodiment. A cylinder 380 is secured to the spider 370 at the central opening 378, and this cylinder 380 serves to support a voice coil 382. The two ends of the voice coil 382 are connected by respective solder joints to respective ones of the conductors 376, and the spider 370 simultaneously centers the voice coil 382 in the annular gap between the front plate 334 and the pole piece 338 and carries electrical current from the perimeter of the spider 370 to the voice coil 382. Alternately, a conventional spider using braided wire conductors can be used instead of the spider 370. When this is done, the braided wire conductors can be soldered to one of the two central forks of each of the terminal straps 420. The remaining one of the two forks supports the braided conductor without a solder bond.

The outer perimeter of the spider 370 is disposed between the spider ring 311 and the ring 340. The locating hole 372 receives the locating stud 348 so as to define the angular position of the spider 370 with respect to the magnet assembly 330. Similarly, the radial lugs 346 of the magnet assembly 330 engage corresponding channels in the frame 310 so as to define the angular position of the magnet assembly 330 with respect to the frame 310. The ridge 344 and groove 314 cooperate to enhance the clamping action between the spider ring 311 and the magnet assembly 330 in order to clamp the spider 370 securely in place.

The diaphragm 306 defines an outer circular perimeter and an inner circular perimeter. The inner circular perimeter of the diaphragm 306 is secured to the cylinder 380, for example by means of a suitable adhesive. The outer perimeter of the diaphragm 306 is similarly secured to an annular surround 384, again by means of a suitable adhesive. The outermost portion of the surround 384 is positioned to overlie a frame clamping surface 386. This clamping surface 386 defines a circular recess 388. A clamping ring 390 operates to clamp the surround 384 in place against the frame clamping surface 386. This clamping ring 390 also defines an annular ridge 392 shaped to mate with the recess 388. The clamping ring 390 defines an annular striking surface 394 as well as an annular locking surface 396.

The frame 310 defines a circular array of locking fingers 400. Each of these locking fingers 400 defines a respective holding surface 402. When the clamping ring 390 is in the position shown in FIG. 24, the holding surfaces 402 of the locking fingers 400 securely lock the clamping ring 390 in place. In this way, the surround 384 is crimped as shown in FIG. 24 into the recess 388 by the ridge 392. This crimping action securely clamps the surround 384 and therefore the diaphragm 306 in place.

As shown in FIG. 24, the grille 320 defines an array of grille locking fingers 410 extending around the perimeter of the grille 320. These grille locking fingers 410 engage correspondingly shaped portions of the outer perimeter of the frame 310 in order to snap lock the grille 320 in place on the frame 310.

Figure 35:
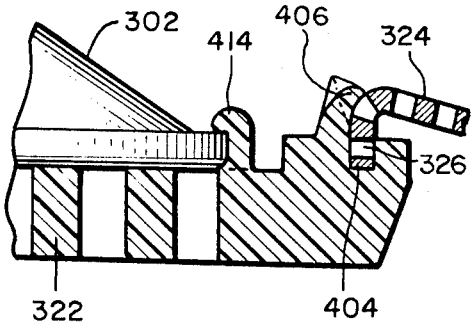
FIG. 35 is a cross sectional view taken along line 35—35 of FIG. 31.

As shown in FIGS. 24 and 35, the inner portion of the grille 420 defines a perimeter groove 404 which extends around the perimeter of the tongue 322 and the opening 323. This perimeter groove 404 is surrounded at its outside edge by a weld ridge 406. The perimeter groove 404 is sized to receive the upstanding portion of the mesh perimeter 326. After the mesh perimeter 326 has been inserted in the perimeter groove 404, the mesh 324 is securely and rigidly bonded in place to the grille. This can be accomplished for example by means of ultrasonic welding techniques which cause the weld ridge 406 to melt and securely hold the mesh perimeter 326 in place in the perimeter groove 404, as shown in FIG. 35. Alternately, adhesive bonding techniques can be used.

Figure 31:
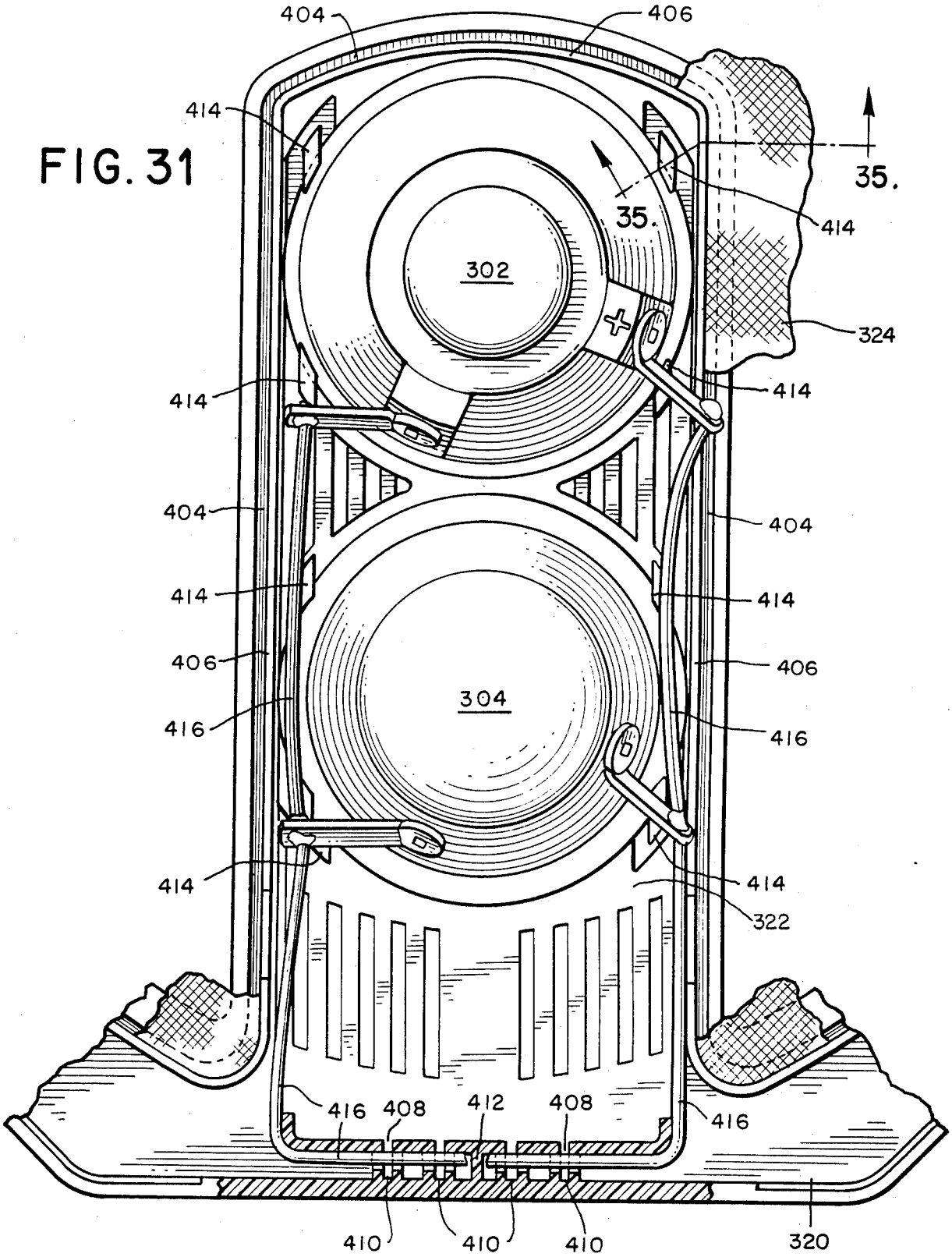
FIG. 31 is a fragmentary plan view of a portion of the inside of the grille of the loudspeaker of FIG. 22.
Figure 32:
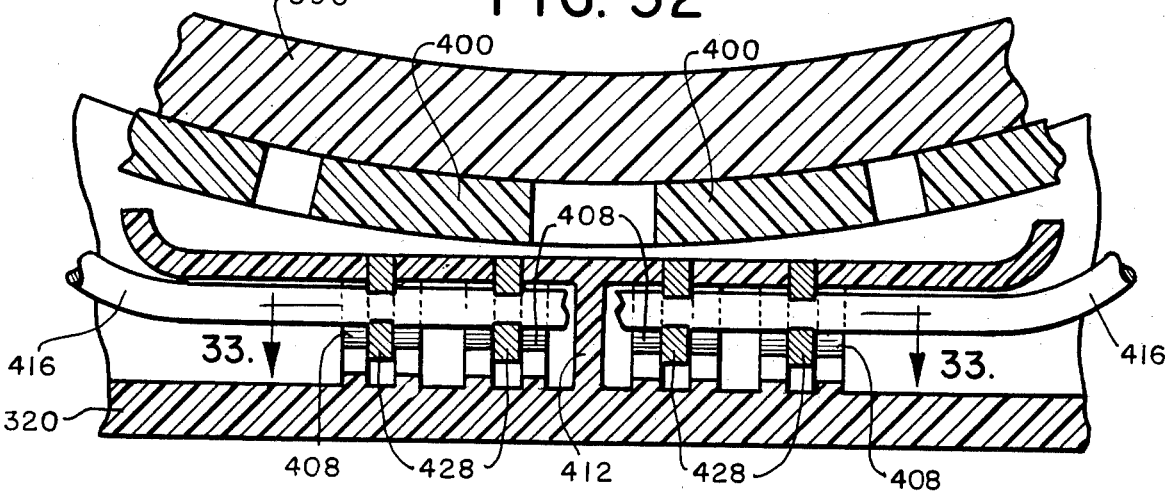
FIG. 32 is a cross sectional view taken along line 32—32 of FIG. 31.

As best shown in FIGS. 31 and 35, the tongue 322 defines two sets of locking fingers 414, which serve to lock the midrange 302 and tweeter 304 in place against the underside of the tongue 322. These locking fingers 414 provide a spring action similar to that of the locking fingers 400 such that the tweeter 304 and the midrange 302 are held in place on tongue 322 by the mechanical action of the locking fingers 414, without adhesives. The inner face of the tongue 322 defines two wire channels 408 sized to receive wires 416 which supply current to the midrange 302 and the tweeter 304. These wire channels 408 are separated by a barrier 412 to prevent short circuiting between the wires 416. In addition, fork channels 410 are defined in the tongue 322 to enable interconnection with the wires 416 as described below.

As best shown in FIGS. 24, and 29–34, two terminal straps 420 are provided for conducting electrical current to the spider 370 and to the wires 416. Each of the terminal straps 420 includes a first end section 422 which defines a roughened surface 424. In addition, each of the terminal straps 420 defines a second end section 426 which defines an upstanding fork 428. An intermediate section 430 interconnects the first and second end sections 422, 426. Two barbs 432 are stamped into the first and second end sections 422, 426. Each of the terminal straps can be formed in one piece from a material such as stamped brass.

The frame 310 defines two pairs of passageways 440, 441 positioned and shaped to receive the first and second end sections 422, 426 of each of the terminal straps 420. As shown in FIG. 30, each of the passageways 440 is formed of a central tab 442 on one side of the passageway 440 and two side tabs 444 on the other side of the passageway 440. The central tab 442 does not overlap to any large extent the side tabs 444. This geometry for the passageway 440 has been found to be more readily molded in the plastic frame 310 than a simple blade shaped passageway. The spacing between the central tab 442 and the side tabs 444 is made sufficiently small to insure a tight fit between the tabs 442, 444 and the end section 442 of the terminal straps 420. In addition, each of the passageways 440 defines a transverse wall 446 positioned and shaped to engage the respective barb 432.

Figure 34:
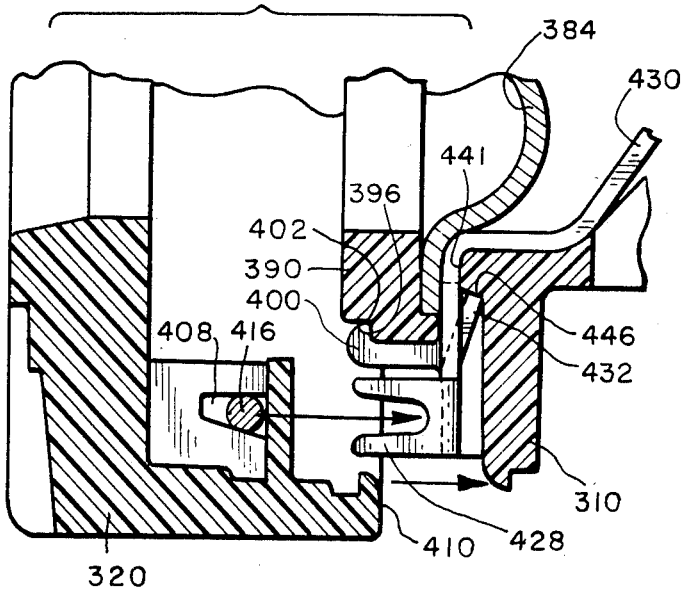
FIG. 34 is a cross sectional view taken along line 34—34 of FIG. 33.

Each of the passageways 441 is shaped as a recess to receive a respective one of the second end sections 426 and defines a respective transverse wall 448 positioned and shaped to engage the respective barb 432 (FIG. 34).

With regard to the materials used in this preferred embodiment, the following information is provided only by way of illustration. The frame 310, grille 320, ring 340, cap 350, and clamping ring 390 can all be formed of a high impact plastic material such as Noryl 300, a trademark of General Electric Co., or other high impact plastics such as ABS. The midrange 302 and tweeter 304 can be conventional speakers, and the diaphragm 306, the cylinder 380, the voice coil 382 and the surround 384 can be formed from the materials used in conventional speakers. The spider 370 can be made out of the materials described above in conjunction with the first preferred embodiment. Furthermore, the magnet assembly 330 is, except for the ring 340, a conventional prior art device. For example, various ceramic materials can be used for the magnet 332, and the front and rear plates 334, 336 and the pole piece 338 can be adhesively secured together.

Figure 36:
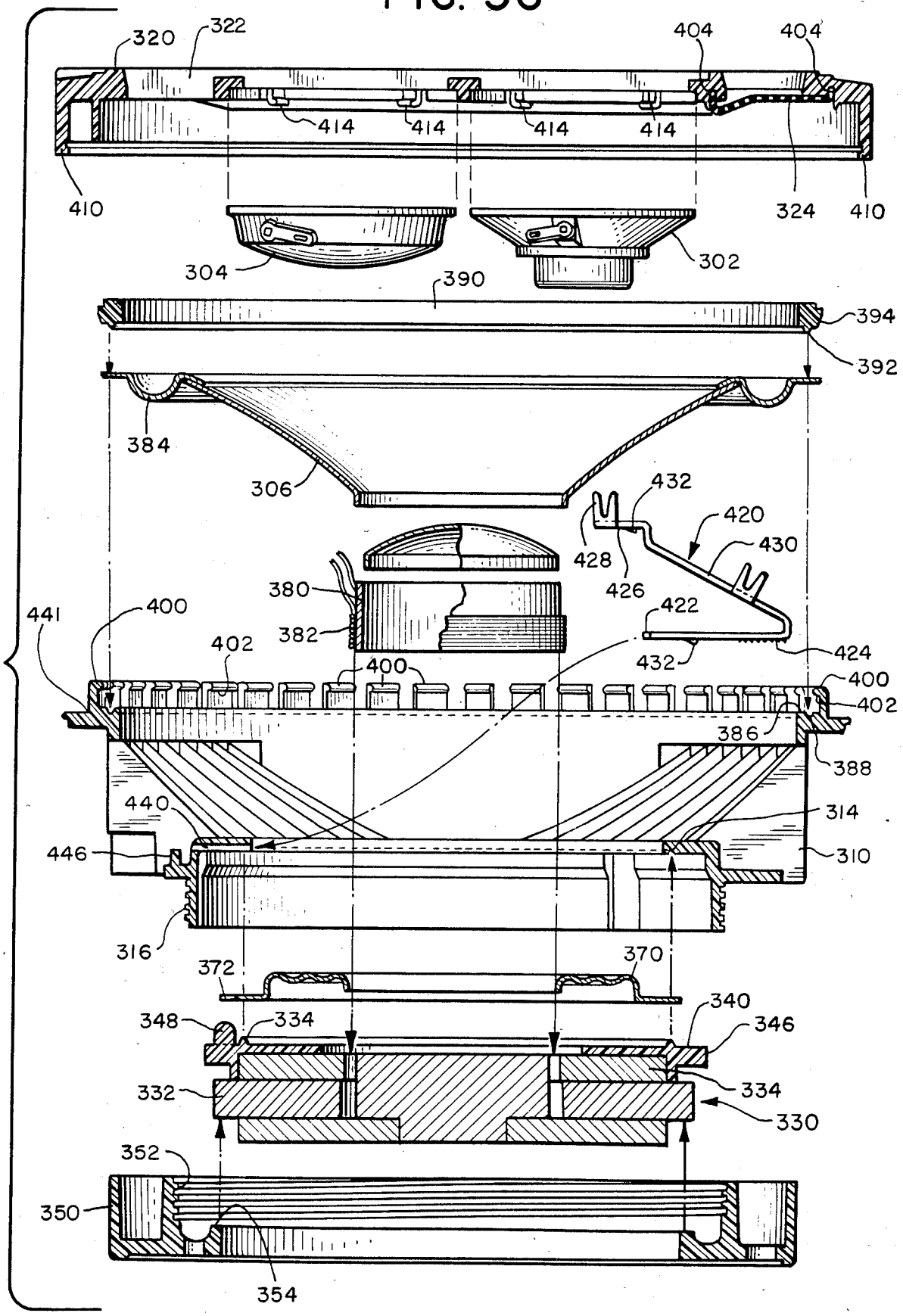
FIG. 36 is an exploded sectional view showing the various components of the speaker of FIG. 22.

With reference to FIG. 36, the embodiment of FIGS. 24–36 can be assembled in a remarkably simple and trouble free manner as follows. First, the two terminal straps 420 are installed in the passageways 440, 441 of the frame 310. This is done by pushing the first and second end sections 422, 426 into the preformed passageways 440, 441 until the barbs 442 engage the transverse walls 446, 448. The barbs 442 are positioned such that a constant tension is applied to the first and second end sections 422, 426 in order to ensure no audible resonances between the terminal straps 420 and the frame 310. As described above, the passageways 440 can be configured to provide a tight fit with the terminal straps 420 in order further to immobilize the terminal straps 420. As shown in FIG. 24 for example, the intermediate section 430 is spaced away from the frame 310 so that inevitable resonance of the intermediate section 430 does not result in audible buzzing noises.

The next step in the assembly of the embodiment of FIGS. 24–36 is to assemble the magnet assembly 330 as described above. The ring 340 is insert molded to the front plate 334, and the various components of the magnet assembly 330 are adhesively bonded together to form a single unit. The spider 370 with the cylinder 380 and voice coil 382 attached to it is then positioned with the locating hole 372 receiving the locating stud 348. The magnet assembly 330 with the spider 370 located thereon is then positioned in the frame 310 in the approximate position shown in FIG. 24. The lugs 346 insure the proper rotational positioning of the magnet assembly 330 and therefore of the spider 370 with respect to the frame 310. In this position, each of the conductors 376 is positioned immediately adjacent to the roughened surface 424 of one of terminal straps 420. The cap 350 is then threaded in place on the threads 316 until the bearing surface 354 engages the magnet 332 and secures both the magnet assembly 330 and the spider 370 in place. During this assembly 330 process, the perimeter of the ring 340 insures precise centering of the magnet assembly 330. As the cap 350 is tightened in place, the ridge 334 defined by the magnet assembly 330 forces the spider 370 into the groove 314 defined by the spider ring 311. In this way, the mechanical engagement and clamping of the spider 370 is enhanced. During the tightening of the cap 350, a centering jig (not shown) can be used to ensure precise centering of the spider 370 and the voice coil 382 with respect to the magnet assembly 330. After the cap 350 has been tightened in place, the cavity 356 between the cap 350, the frame 310, and the magnet assembly 330 can be filled with a suitable adhesive such as *C. P. Moyen VS6000-AFR vinyl base fire retardent adhesive or equivalent.* This adhesive is introduced through a pair of ports 358 in the cap 350 in order to immobilize the magnet assembly 330 in place and to make removal of the cap 350 more difficult.

At this point, the diaphragm 306, which has previously been adhesively attached to the surround 384, can be adhesively attached to the cylinder 380. After this has been done, the surround 384 will overlie the frame clamping surface 386, and the clamping ring 390 can be moved into the position shown in FIG. 24. As the clamping ring 390 is moved towards the frame clamping surface 386, the striking surface 394 serves to push the locking fingers 400 aside. After the clamping ring 390 has been moved to the position of FIG. 24, the locking fingers 400 resiliently resume the position shown in FIG. 24, in which the holding surfaces 402 securely lock the clamping ring 390 in place. As shown in FIG. 24, the outer perimeter of the surround 384 is crimped by the ridge 392 into the recess 388 of the clamping surface 386. In this way a reliable, stable clamping of the surround 384 is obtained.

The clamping ring 390 also serves to immobilize the second end sections 426 of the terminal straps 420 and to ensure that the barbs 432 of the second end sections 426 engage the transverse walls 446.

After all centering operations have been completed, a dust cap can be secured over the open end of the cylinder 380. At this point, the woofer speaker which includes the woofer diaphragm 306 is complete. Electrical connection with the voice coil 382 is provided by the terminal straps 420. Depending upon the grille used to complete assembly, this subunit can be used as part of a one-way, two-way or three-way speaker.

In order to complete assembly of the embodiment shown in FIG. 24, the midrange 302 and tweeter 304 are snapped in place in receiving wells defined in the tongue 322 of the grille 320. The locking fingers 414 serve to secure the tweeter 304 and midrange 302 in position securely and mechanically, with an action similar to the locking fingers 400 described above. The midrange 302 and tweeter 304 are connected in parallel between two wires 416. If desired, a suitable crossover network (not shown) can be provided for the midrange 302 and the tweeter 304. These wires 416 are pushed into the wire channels 408 defined on the underside of the tongue 322. The barrier 412 ensures no short circuit occurs between the two wires 416, and the wire channels 408 immobilize the wires 416 in the desired position for the interconnection to follow. Prior to assembly of the midrange 302 and the tweeter 304, the mesh 324 is installed in the perimeter groove 404 and ultrasonically welded in place as described above (FIG. 35). This mesh 324 provides a structural function in that it stiffens the cantilevered tongue 322, thereby allowing the tongue 322 to be used to support the midrange 302 and the tweeter 304. In this embodiment, the mesh 324 is a woven, metal mesh of sufficient rigidity to provide significant structural support to the tongue 322.

Figure 33:
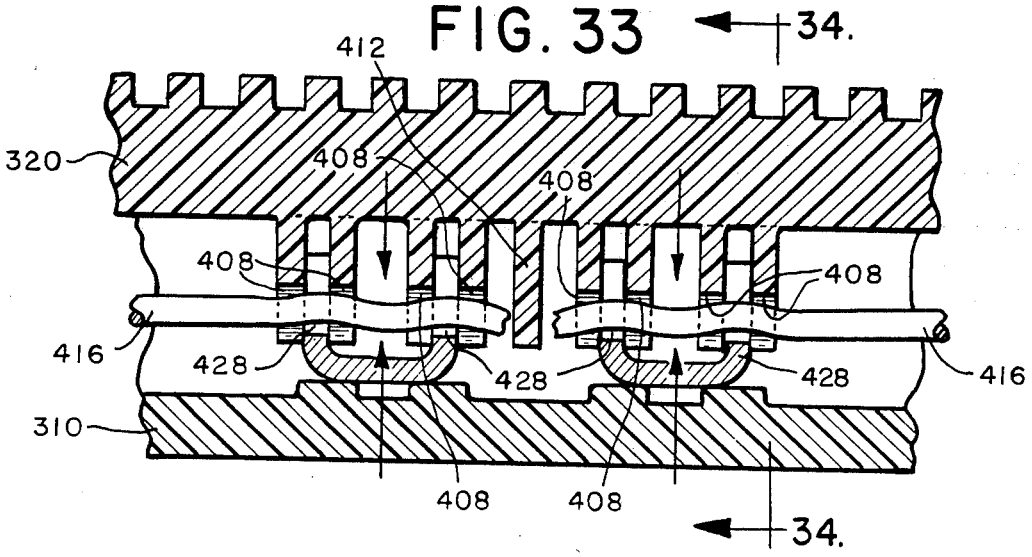
FIG. 33 is a cross sectional view taken along line 33—33 of FIG. 32, after the grille is installed on the frame.

After the subassembly of the grille 320 has been completed, the grille 320 with the midrange 302 and the tweeter 304 mounted thereon is properly oriented and snapped in place on the frame 310. The grille locking fingers 410 engage mating surfaces on the frame 310 and operate in a manner similar to the locking fingers 400 described above to hold the grille 320 in place securely on the frame 410. FIG. 34 shows the grille 320 aligned with but spaced from the frame 310, and FIG. 33 shows the final, assembled relationship of these parts. As the grille 320 is being snapped in place, the wires 416 are guided between the forks 428 of the respective terminal straps 420, as shown in FIGS. 33 and 34. The forks 428 are dimensioned such that the forks 428 automatically provide secure electrical interconnections with the wires 416 as the wires 416 are forced between the forks 428. Thus, the simple act of snapping the grille 320 in place simultaneously mounts the grille 320, the midrange 302, and the tweeter 304 in place, and established electrical interconnection with the midrange 302 and the tweeter 304.

From the foregoing, it should be apparent that the preferred embodiment of FIGS. 24–36 includes a number of features which cooperate to provide remarkable ease of assembly. The threaded cap 350 functions simultaneously (1) to hold the magnet assembly 330 in position, (2) to crimp and hold the spider 370 in position, (3) to make electrical contact between the conductors 376 of the spider 370 and the terminal straps 420, and (4) to immobilize the first end sections 422 of the terminal straps 420, thereby further reducing the incidence of audible resonance. Furthermore, since the threaded coupling made up of the threads 352, 316 is continuously adjustable, inevitable tolerances in the thickness of the magnet assembly 330 can readily be taken up and accomodated.

Similarly, the clamping ring 390 simultaneously holds the surround 384 in place and immobilizes the second end sections 426 of the terminal straps 420.

Another important feature is that the clamping ring 390 is an annular ring separate from the grille 320. Because the clamping ring 390 does not extend across the center of the diaphragm 306, centering jigs can be used to center the diaphragm 306 and the cylinder 380 as the clamping ring 390 is moved into its clamping position.

Yet another important point is the manner in which the various features of the grille 320 allow the midrange 302 and tweeter 304 to be mounted in place in a simple mechanical way which allows simple and reliable interconnection by means of the second ends 426 of the terminal straps 420. The insert molded ring 340 improves the precision of alignment of the magnet assembly 330, and the mesh 324 enables the cantilevered tongue 322 to support the speakers 302, 304 properly.

Of course, it should be understood that various changes and modifications to the preferred embodiments described above will be apparent to those skilled in the art. For example, the snap ring and face plate may include detent means other than the locking fingers of the preferred embodiments such as bayonet or screw type threads or locking fingers formed on the basket rather than upon the snap ring and face plate. Further, the locking fingers may engage shallow recesses rather than the openings of certain of the preferred embodiments described above. Moreover, in some embodiments, the magnet assembly itself may be threaded and the need for a separate threaded cap eliminated. Additionally, various embodiments of the present invention may be adapted for specific sizes and shapes of loudspeakers or multiple loudspeaker systems. It is threfore intended that the foregoing detailed description be regarded as illustrative rather than limiting and that it be understood that it is the following claims, including all equivalents, that are intended to define the scope of this invention.

I claim:

1. In a loudspeaker of the type comprising a frame, a diaphragm, and a spider secured to the diaphragm, the improvement comprising:

a first mounting member, secured to the frame and located at a perimeter region of the spider;

a second mounting member held in place with respect to the frame and located to clamp the perimeter region of the spider between the first and second mounting members in order to locate the spider and hold it in place with respect to the frame mechanically;

one of the mounting members comprising a ridge and the other of the mounting members defining a mating groove positioned such that the ridge forces the perimeter region of the spider into the groove to enhance the clamping action of the mounting members.

2. The loudspeaker of claim 1 wherein the loudspeaker further comprises a magnet assembly mounted to the frame and wherein the second mounting member is included in the magnet assembly.

3. The loudspeaker of claim 2 wherein the first mounting member comprises a ring integrally formed with the frame.

4. The loudspeaker of claim 2 wherein the magnet assembly comprises a front metallic plate and an annular plastic ring, wherein the ring is insert molded on the plate, and wherein the second mounting member is included in the annular plastic ring.

5. In a loudspeaker of the type comprising a frame, a diaphragm, a surround mounted between the diaphragm and the frame, a spider mounted to the diaphragm, and a magnet assembly mounted to the frame, the improvement comprising:

a first mounting member included in the magnet assembly adjacent to a first side of the spider;

a second mounting member integrally formed with the frame such that the spider is securely clamped and held in place between the first and second mounting members.

6. The loudspeaker of claim 5 wherein one of the mounting members comprises a raised surface, wherein the other of the mounting members comprises a mating recessed surface positioned such that the raised surface pushes the spider against the recessed surface to enhance the clamping action of the mounting members.

7. The loudspeaker of claim 6 wherein the raised surface comprises a circular ridge and wherein the recessed surface defines a circular trough.

8. The loudspeaker of claim 5 wherein the second mounting member is ring shaped.

9. The loudspeaker of claim 5 wherein the frame comprises a first threaded surface, wherein the magnet assembly is coupled to a second threaded surface, configured to mate with the first threaded surface, and wherein the first and second threaded surfaces are threadedly engaged in order simultaneously to hold the magnet assembly in place and to clamp the spider between the first and second mounting members.

10. The loudspeaker of claim 5 wherein the first mounting member comprises a plastic ring insert molded to a portion of the magnet assembly.

11. In a loudspeaker of the type comprising a frame, magnet assembly secured to the frame, a diaphragm, and a surround secured to the diaphragm, the improvement comprising:

a first clamping member secured to the frame;

a second clamping member;

an array of resilient locking fingers secured to one of the first and second clamping members to hold the second clamping member in place against the first clamping member with the surround clamped between the two clamping members, said locking fingers configured to move aside as the second clamping member is moved into position against the first clamping member and then to spring back to automatically lock the second clamping member in place mechanically.

12. The loudspeaker of claim 11 wherein the second clamping member is ring shaped and wherein the locking fingers are mounted on the frame adjacent to the first clamping member.

13. The loudspeaker of claim 11 wherein one of the clamping members comprises a raised surface, wherein the other of the clamping surface comprises a mating recessed surface, and wherein the raised surface forces the surround against the recessed surface to enhance the clamping action of the clamping members.

14. The loudspeaker of claim 13 wherein the raised surface comprises an annular ridge extending around the surround and wherein the recessed surface defines an annular groove.

15. In a loudspeaker of the type comprising a frame, a magnet assembly secured to the frame, a diaphragm, and a surround secured to the diaphragm, the improvement comprising:

a first annular clamping member included in the frame and positioned adjacent to an outer peripheral portion of the surround;

an array of resilient locking fingers secured to the frame around and outside of the first clamping member, each locking finger defining a respective striking surface and a respective holding surface;

a ring shaped second clamping member mechanically locked in place by the locking fingers in order to mechanically clamp the surround between the clamping members, said second clamping member shaped to contact the striking surfaces in order to push the locking fingers aside as the second clamping member is moved toward the first clamping member, and to engage the holding surfaces after the second clamping member has been moved into place against the surround, said locking fingers acting to mechanically lock the second clamping member, and therefore the surround, in place with respect to the frame;

a projecting surface included in one of the clamping members; and a recessed surface included in the other of the clamping members and positioned to mate with the projecting surface to deform and clamp the surround therebetween.

16. The of claim 15 wherein the projecting surface comprises an annular ridge which extends completely around the surround, and wherein the recessed surface defines an annular groove which extends completely around the surround.

17. The loudspeaker of claim 15 wherein the loudspeaker further comprises a grille, separate from the second clamping member.

18. In a loudspeaker of the type comprising a frame, a diaphragm mounted to the frame, a spider mounted to extend between the frame and the diaphragm to support a voice coil, and at least one additional speaker, the improvement comprising:

a terminal strap which comprises first and second end sections and an intermediate section;

first and second barbs included in the first and second end sections respectively;

means, situated on the terminal strap, for establishing electrical contact with the voice coil;

means, situated on the second end section, for establishing electrical contact with the additional speaker;

means for defining first and second passages in the frame, each positioned to receive a respective one of the first and second end sections and each comprising a respective wall positioned to engage the respective barb;

said terminal strap positioned with the first and second end sections in the first and second passages, respectively, such that the first and second barbs engage the respective transverse walls to hold the terminal strap securely in the frame and prevent audible resonance of the end sections during operation of the loudspeaker.

19. The loudspeaker of claim 18 wherein the means for establishing contact with the voice coil comprises a roughened surface included in the first end section.

20. The loudspeaker of claim 18 wherein the contact establishing means on the second end section comprises at least one fork.

21. The loudspeaker of claim 18 wherein the first and second end sections of the terminal strap are oriented parallel to one another.

22. The loudspeaker of claim 18 wherein a portion of the frame situated between the passages is shaped to ensure that the intermediate section is spaced from the frame to prevent audible resonance of the intermediate section against the frame during operation of the loudspeaker.

23. The loudspeaker of claim 18 wherein at least one of the passages is at least partially surrounded by a plurality of staggered tabs, said plurality of tabs comprising a pair of outer tabs on one side of the terminal strap and at least one central tab on the other side of the terminal strap, between the outer tabs, said central and outer tabs cooperating to engage the terminal strap tightly.

24. The loudspeaker of claim 18 further comprising spider mounting means for forcing the spider against the first end section, thereby further immobilizing the first end section against the frame.

25. The loudspeaker of claim 18 wherein the loudspeaker further comprises a surround mounted to the diaphragm, and wherein the improvement further comprises surround mounting means for forcing the surround against the second end section, thereby further immobilizing the second end section against the frame.

26. In a loudspeaker of the type comprising a frame, a diaphragm mounted to the frame, a spider having at least one conductor and is mounted to extend between the frame and the diaphragm, and at least one additional speaker, the improvement comprising:

a terminal strap which comprises first and second end sections and an intermediate section;

first and second barbs included in the first and second end sections respectively;

a roughened surface of the first end section positioned to establish electrical contact with one of the spider conductors;

a fork included in the second end section for establishing electrical contact with the additional speaker;

said frame forming a pair of passages positioned to receive the first and second end sections, respectively, each of said passages situated adjacent a respective barb engaging wall;

the first and second end sections of the terminal strap oriented parallel to one another, the end sections and the intermediate section each being substantially rectilinear, and said terminal strap configured such that each of the barbs engages a respective one of the barb engaging walls to securely hold the end sections in the frame;

said terminal strap and frame shaped such that the intermediate section is spaced from the frame;

a magnet assembly;

a first set of threads formed on the frame; and a second set of threads coupled to the magnet assembly, said first and second sets of threads forming a threaded connection which holds the magnet assembly against the frame and which clamps the spider and the first end section between the frame and the magnet assembly, thereby further immobilizing the first end section.

27. The loudspeaker of claim 26 wherein at least one of the passages is at least partially surrounded by a plurality of staggered tabs, said plurality of tabs comprising a pair of outer tabs on one side of the terminal strap and at least one central tab on the other side of the terminal strap, between the outer tabs, said central and outer tabs cooperating to engage the terminal strap tightly.

28. In a loudspeaker magnet assembly of the type comprising a front plate, a magnet secured to the front plate, and a rear plate secured to the magnet, the improvement comprising:

a locating ring molded in place around a peripheral portion of the front plate, said locating ring precisely defining a set of radially oriented locating surfaces to precisely position the magnet assembly radially.

29. The assembly of claim 28 wherein the locating surfaces comprise a plurality of radially extending lugs.

30. The assembly of claim 28 wherein the locating ring comprises an axial face, and wherein the axial face comprises a raised surface.

31. The assembly of claim 30 wherein the raised surface comprises a circular ridge.

32. In a loudspeaker magnet assembly of the type comprising an annular front plate, an annular magnet secured to the front plate, a disc shaped rear plate secured to the magnet opposite the front plate, and a pole piece secured to the rear plate to extend through central openings defined by the front plate and the magnet, the improvement comprising:

a locating ring molded in place around a peripheral portion of the front plate, said locating ring comprising an array of radially extending locating lugs and an axially extending circular ridge facing away from the magnet.

33. In a loudspeaker of the type having a first speaker diaphragm, a support structure disposed over the first speaker diaphragm, and a second speaker, sized to fit within the first speaker diaphragm, the improvement comprising:

an array of snap locking fingers mounted on the support structure, each comprising a locking surface configured to engage the second speaker to hold the second speaker securely in place mechanically against the support structure, such that only mechanical forces support the second speaker on the support structure.

34. In a loudspeaker of the type comprising a first speaker diaphragm and a second speaker, sized to fit within the first speaker diaphragm, the improvement comprising:

a frame which supports the first speaker diaphragm;

a grille which comprises a cantilevered tongue which extends over the first speaker diaphragm and supports the second speaker; and a grille mesh rigidly secured to the grille and the tongue to extend between the grille and the tongue, said grille mesh providing structural support to the cantilevered tongue to enable the tongue to properly support the second speaker.

35. The loudspeaker of claim 34 wherein the invention further comprises an array of locking fingers secured to the tongue and effective to mechanically hold the second speaker in position on the tongue.

36. The loudspeaker of claim 34 wherein the grille and the tongue define a peripheral groove extending around the perimeter of the tongue, and wherein a perimeter portion of the mesh is positioned in the groove.

* * * * *